US010115273B2

(12) United States Patent
Uss et al.

(10) Patent No.: US 10,115,273 B2
(45) Date of Patent: Oct. 30, 2018

(54) GAMING SYSTEM AND METHOD PROVIDING A GAME INCLUDING A PLURALITY OF CONCENTRIC WHEELS HAVING DEACTIVATABLE SEGMENTS

(71) Applicant: IGT, Las Vegas, NV (US)

(72) Inventors: Jeffrey Uss, Reno, NV (US); John Ludwick, Reno, NV (US)

(73) Assignee: IGT, Las Vegas, NV (US)

( * ) Notice: Subject to any disclaimer, the term of this patent is extended or adjusted under 35 U.S.C. 154(b) by 730 days.

(21) Appl. No.: 14/682,607

(22) Filed: Apr. 9, 2015

(65) Prior Publication Data

US 2016/0300454 A1 Oct. 13, 2016

(51) Int. Cl.
*G07F 17/32* (2006.01)
*G07F 17/34* (2006.01)

(52) U.S. Cl.
CPC ..... *G07F 17/34* (2013.01); *G07F 17/326* (2013.01); *G07F 17/3244* (2013.01); *G07F 17/3288* (2013.01)

(58) Field of Classification Search
None
See application file for complete search history.

(56) References Cited

U.S. PATENT DOCUMENTS 5,395,111 A 3/1995 Inoue
5,788,573 A 8/1998 Baerlocher et al.
5,823,874 A 10/1998 Adams et al.
5,848,932 A 12/1998 Adams et al.
5,911,418 A 6/1999 Adams et al.
6,162,121 A 12/2000 Morro et al.
6,168,520 B1 1/2001 Baerlocher et al.
6,224,483 B1 5/2001 Mayeroff
6,413,161 B1 7/2002 Baerlocher et al.
6,439,995 B1 8/2002 Hughs-Baird et al.
6,561,908 B1 5/2003 Hoke
(Continued)

OTHER PUBLICATIONS

Super Wheel Blast, available at https://www.gamingtoday.com/articles/article/51914-Aristocrat_New_Slot_Profile_Super_Wheel_Blast#.VOZuD-bF_fQ, printed on Feb. 19, 2015 (2 pages).
(Continued)

*Primary Examiner* — Jason Skaarup
(74) *Attorney, Agent, or Firm* — Neal, Gerber & Eisenberg LLP

(57) ABSTRACT

Various embodiments of the present disclosure are directed to a gaming system and method providing a game including a plurality of concentric objects, such as wheels, having segments that can switch from an activated state to a deactivated state. In various embodiments, the plurality of concentric objects includes a plurality of wheels. Generally, for a play of the concentric wheel game in various embodiments, the gaming system spins the wheels a plurality of times and, for each spin, selects a selectable activated segment of one of the wheels, provides an award associated with the selected segment, and deactivates the selected segment such that the selected segment is not selectable for the remainder of the play of the concentric game. Deactivating a segment can, in certain instances, make another previously un-selectable activated segment selectable and/or increase the probability of selecting another activated segment.

20 Claims, 17 Drawing Sheets

(56) References Cited

U.S. PATENT DOCUMENTS 6,572,472 B1 6/2003 Glavich
6,575,830 B2 6/2003 Baerlocher et al.
6,585,591 B1 7/2003 Baerlocher et al.
6,595,854 B2 7/2003 Hughs-Baird et al.
6,605,000 B2 8/2003 Adams
6,632,140 B2 10/2003 Berman et al.
6,634,943 B1 10/2003 Baerlocher
6,634,945 B2 10/2003 Glavich et al.
6,663,448 B1 12/2003 Davies et al.
6,663,489 B2 12/2003 Baerlocher
6,733,386 B2 5/2004 Cuddy et al.
6,749,504 B2 6/2004 Hughs-Baird
6,783,455 B2 8/2004 Glavich
6,793,577 B1 9/2004 Wilkins et al.
6,802,775 B2 10/2004 Baerlocher et al.
D498,268 S 11/2004 Kaminkow et al.
6,827,646 B2 12/2004 Adams
D503,951 S 4/2005 Karstens
6,875,108 B1 4/2005 Hughs-Baird
6,890,255 B2 5/2005 Jarvis et al.
6,899,625 B2 * 5/2005 Luciano, Jr. ..... G07F 17/3244 463/20
6,910,962 B2 6/2005 Marks et al.
6,913,533 B2 7/2005 Cuddy et al.
D512,464 S 12/2005 Karstens
D512,465 S 12/2005 Karstens
6,971,955 B2 12/2005 Baerlocher et al.
6,974,129 B2 12/2005 Nordman
6,979,263 B2 12/2005 Baerlocher et al.
6,986,710 B2 1/2006 Baerlocher et al.
6,991,538 B2 1/2006 Cannon
6,997,804 B2 2/2006 Berman
7,004,835 B2 2/2006 Baerlocher
7,014,560 B2 3/2006 Glavich et al.
7,056,213 B2 6/2006 Ching et al.
7,066,814 B2 6/2006 Glavich et al.
7,074,127 B2 7/2006 Cuddy et al.
7,090,580 B2 8/2006 Rodgers et al.
7,094,148 B2 8/2006 Baerlocher et al.
7,104,886 B2 9/2006 Baerlocher et al.
7,144,321 B2 12/2006 Mayeroff
7,153,205 B2 12/2006 Baerlocher
7,160,186 B2 1/2007 Cuddy et al.
7,179,169 B2 2/2007 Beaulieu et al.
7,182,689 B2 2/2007 Hughs-Baird et al.
7,198,570 B2 4/2007 Rodgers et al.
7,226,358 B2 6/2007 Miller et al.
7,273,415 B2 9/2007 Cregan et al.
7,306,520 B2 12/2007 Kaminkow et al.
7,311,598 B2 12/2007 Kaminkow et al.
7,311,604 B2 12/2007 Kaminkow et al.
7,326,109 B2 2/2008 Baerlocher
7,331,861 B2 2/2008 Nordman
7,331,862 B2 2/2008 Rodgers et al.
7,331,866 B2 2/2008 Rodgers et al.
7,354,342 B2 4/2008 Paulsen et al.
7,357,713 B2 4/2008 Marks et al.
7,361,089 B2 * 4/2008 Daly ..... G07F 17/3211 273/143 R
7,371,169 B2 5/2008 Baerlocher
7,371,170 B2 5/2008 Cregan et al.
7,371,172 B2 5/2008 Inoue
7,399,226 B2 7/2008 Mishra
7,399,228 B2 7/2008 Baerlocher
7,425,177 B2 9/2008 Rodgers et al.
7,427,236 B2 9/2008 Kaminkow et al.
7,431,649 B2 10/2008 Webb et al.
7,442,123 B2 10/2008 Brill et al.
7,448,948 B2 11/2008 Hughs-Baird et al.
7,448,949 B2 11/2008 Kaminkow et al.
7,503,848 B2 3/2009 Berman et al.
7,544,129 B2 6/2009 Baerlocher
7,575,514 B2 8/2009 Cuddy et al.
7,578,735 B2 8/2009 Frizzell et al.
7,578,737 B2 8/2009 Cregan et al.
7,578,738 B2 8/2009 Cregan et al.
7,591,723 B2 9/2009 Cregan et al.
7,614,952 B2 11/2009 Elias
7,625,278 B2 12/2009 Paulsen et al.
7,666,092 B2 2/2010 Kaminkow et al.
7,674,168 B2 3/2010 Gerrard et al.
7,674,172 B2 3/2010 Miltenberger et al.
7,690,978 B2 4/2010 Webb et al.
7,690,986 B2 4/2010 Ching et al.
7,708,628 B2 5/2010 Baerlocher
7,708,630 B2 5/2010 Nicely
7,722,462 B2 5/2010 Mayeroff
7,731,584 B2 6/2010 Glavich et al.
7,749,063 B2 7/2010 Belger et al.
7,749,070 B2 7/2010 Baerlocher et al.
7,753,773 B2 7/2010 Baerlocher et al.
7,771,267 B2 8/2010 Mayeroff
7,771,268 B2 8/2010 Mayeroff
7,771,270 B2 8/2010 Kaminkow et al.
7,775,874 B2 8/2010 Ching et al.
7,780,520 B2 8/2010 Baerlocher
7,785,185 B2 8/2010 Webb et al.
7,794,317 B2 9/2010 Kaminkow et al.
7,806,760 B2 10/2010 Baerlocher
7,833,095 B2 11/2010 Cuddy et al.
7,841,936 B2 11/2010 Berman et al.
7,850,171 B2 12/2010 Bontempo et al.
7,850,521 B2 12/2010 Rodgers et al.
7,857,695 B2 12/2010 Rodgers et al.
7,874,912 B2 1/2011 Cregan et al.
7,896,734 B2 3/2011 Kaminkow et al.
7,922,573 B2 4/2011 Baerlocher et al.
7,942,737 B2 5/2011 Cregan et al.
7,967,676 B2 6/2011 Rodgers et al.
8,006,978 B2 8/2011 Bontempo et al.
8,007,357 B2 8/2011 Cuddy et al.
8,057,308 B2 11/2011 Kaminkow et al.
8,079,903 B2 12/2011 Nicely et al.
8,083,581 B2 12/2011 Marks et al.
8,092,293 B2 1/2012 Richards et al.
8,092,296 B2 1/2012 Inoue
8,100,754 B2 1/2012 Bigelow, Jr. et al.
8,105,149 B2 1/2012 DeWaal
8,142,274 B2 3/2012 Baerlocher
8,152,171 B2 4/2012 Miltenberger et al.
8,162,743 B2 4/2012 Beaulieu et al.
8,177,234 B2 5/2012 Nicely
8,210,937 B2 7/2012 Cregan et al.
8,210,944 B2 7/2012 Mead
8,221,214 B2 7/2012 Nicely
8,226,085 B2 7/2012 Bontempo et al.
8,246,445 B2 8/2012 Rodgers et al.
8,246,472 B2 8/2012 Kaminkow et al.
8,251,798 B2 8/2012 Belger et al.
8,262,458 B2 9/2012 Rodgers et al.
8,308,547 B2 11/2012 Walker et al.
8,342,941 B2 1/2013 Nicely
8,353,762 B2 1/2013 Rodgers et al.
8,388,436 B2 3/2013 Rodgers et al.
8,419,549 B2 4/2013 Kaminkow et al.
8,444,477 B2 5/2013 Inoue
8,460,084 B2 6/2013 Kaminkow et al.
8,460,098 B2 6/2013 Mead
8,517,381 B2 8/2013 Bontempo et al.
8,574,059 B2 11/2013 Rodgers et al.
8,888,580 B2 11/2014 Caputo et al.
2004/0067791 A1 * 4/2004 Glavich ..... G07F 17/32 463/20
2005/0059478 A1 3/2005 Peterson et al.
2005/0215307 A1 9/2005 Jarvis et al.
2006/0237905 A1 10/2006 Nicely et al.
2007/0060271 A1 * 3/2007 Cregan ..... G07F 17/32 463/16
2007/0060275 A1 3/2007 Gilmore et al.
2008/0090655 A1 4/2008 Marks et al.
2008/0182638 A1 * 7/2008 Paulsen ..... G07F 17/34 463/16
2011/0212760 A1 9/2011 Rodgers et al.
2011/0218029 A1 9/2011 Rodgers et al.

(56) References Cited

U.S. PATENT DOCUMENTS

| | | | |
|---|---|---|---|
| 2012/0094741 | A1 | 4/2012 | Bigelow, Jr. et al. |
| 2012/0157180 | A1 | 6/2012 | Baerlocher |
| 2012/0172123 | A1 | 7/2012 | Beaulieu et al. |
| 2012/0270630 | A1 | 10/2012 | Bontempo et al. |
| 2012/0282992 | A1 | 11/2012 | Bontempo et al. |
| 2012/0322534 | A1 | 12/2012 | Belger et al. |
| 2013/0059638 | A1 | 3/2013 | Nicely |
| 2013/0059647 | A1 | 3/2013 | Nicely |
| 2013/0102378 | A1 | 4/2013 | Rodgers et al. |
| 2013/0116033 | A1 | 5/2013 | Nicely |
| 2013/0143650 | A1 | 6/2013 | Rodgers et al. |
| 2013/0217460 | A1 | 8/2013 | Kaminkow et al. |
| 2013/0225268 | A1 | 8/2013 | Caputo et al. |

OTHER PUBLICATIONS

Brick Breaker, available at http://www.makeuseof.com/tag/simple-brick-breaker-the-old-classic-game-remains-as-addictive-as-it-was-before-iphone/, printed on Feb. 19, 2015 (6 pages).

* cited by examiner

Segments from the two outermost wheels are now selectable! Spin again to see what you win!

260

| 262 | 264 | 266 |
|---|---|---|
| Spins Remaining | SPIN | Bonus Award |
| 7 | | 50 |

1000

GAMING SYSTEM AND METHOD PROVIDING A GAME INCLUDING A PLURALITY OF CONCENTRIC WHEELS HAVING DEACTIVATABLE SEGMENTS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming system generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure are directed to a gaming system and method providing a game including a plurality of concentric objects having segments that can switch from an activated state (in which the segments can be selected during a play of the game) to a deactivated state (in which the segments can no longer be selected during the play of the game). In various embodiments, the plurality of concentric objects includes a plurality of concentric wheels. Generally, for a play of the concentric wheel game in various embodiments, the gaming system spins the wheels a plurality of times and, for each spin: selects a selectable activated segment of one of the wheels, provides any award associated with the selected segment, and deactivates the selected segment such that the selected segment is not selectable for at least one subsequent spin of the wheels of the play of the concentric wheel game (such as the remaining spin(s) of the wheels of the play of the concentric wheel game). Deactivating a segment can, in certain instances, make another previously un-selectable activated segment selectable and/or increase the probability of selecting another activated segment.

More specifically, in operation of one embodiment in which the objects are wheels, the gaming system initiates (such as upon an occurrence of a triggering event) a play of a game associated with a plurality of concentric wheels and a quantity of spins of the wheels. Each wheel includes a plurality of segments, each segment has an activated state and a deactivated state (and is switchable from the activated state to the deactivated state during a play of the concentric wheel game), and each segment is either selectable or un-selectable. Initially, each segment is in the activated state, at least one activated segment is selectable, and at least one activated segment is un-selectable. The gaming system spins the plurality of wheels, randomly selects a selectable activated segment of one of the plurality of wheels, stops the plurality of wheels such that the randomly selected segment is indicated, and displays an award associated with the randomly selected segment. The gaming system reduces the quantity of spins and determines whether any spins remain. If no spins remain, the gaming system ends the play of the concentric wheel game. If one or more spins remain for the play of the concentric wheel game, the gaming system switches the selected segment from the activated state to the deactivated state, rendering that segment un-selectable, and spins the plurality of wheels again.

In certain embodiments, certain un-selectable activated segments of certain of the plurality of wheels remain un-selectable by the gaming system until the gaming system deactivates one or more activated segments of one or more other wheels. For instance, in one embodiment, the concentric wheel game is associated with a first wheel, a second wheel, and a third wheel. The first wheel completely surrounds the second wheel and the second wheel completely surrounds the third wheel. In this embodiment, the gaming system cannot select any activated segment of the second wheel (i.e., the activated segments of the second wheel are initially un-selectable) until the gaming system has deactivated at least one activated segment of the first wheel. Additionally, in this embodiment, the gaming system cannot select any activated segment of the third wheel (i.e., the activated segments of the third wheel are initially un-selectable) until the gaming system has deactivated at least one activated segment of the first wheel and at least one activated segment of the second wheel. Put differently, in this embodiment, once the gaming system switches a first segment of the first wheel from the activated state to the deactivated state, a probability of selecting an activated segment of the second wheel increases (from a probability of 0% to a probability of greater than 0%). Similarly, once the gaming system switches a first segment of the first wheel from the activated state to the deactivated state and a first segment of the second wheel from the activated state to the deactivated state, a probability of selecting an activated segment of the third wheel increases (from a probability of 0% to a probability of greater than 0%).

The gaming system and method of the present disclosure thus provide a new game to increase player enjoyment, entertainment, and excitement.

Additional features and advantages are described herein, and will be apparent from, the following Detailed Description and the Figures.

DETAILED DESCRIPTION

Game Including a Plurality of Concentric Wheels Having Deactivatable Segments Various embodiments of the present disclosure are directed to a gaming system and method providing a game including a plurality of concentric objects having segments that can switch from an activated state (in which the segments can be selected during a play of the game) to a deactivated state (in which the segments can no longer be selected during the play of the game). In various embodiments, the plurality of concentric objects includes a plurality of concentric wheels. Generally, for a play of the concentric wheel game in various embodiments, the gaming system spins the wheels a plurality of times and, for each spin: selects a selectable activated segment of one of the wheels, provides any award associated with the selected segment, and deactivates the selected segment such that the selected segment is not selectable for the remainder of the play of the concentric wheel game. Deactivating a segment can, in certain instances, make another previously un-selectable activated segment selectable and/or increase the probability of selecting another activated segment.

Figure 1:
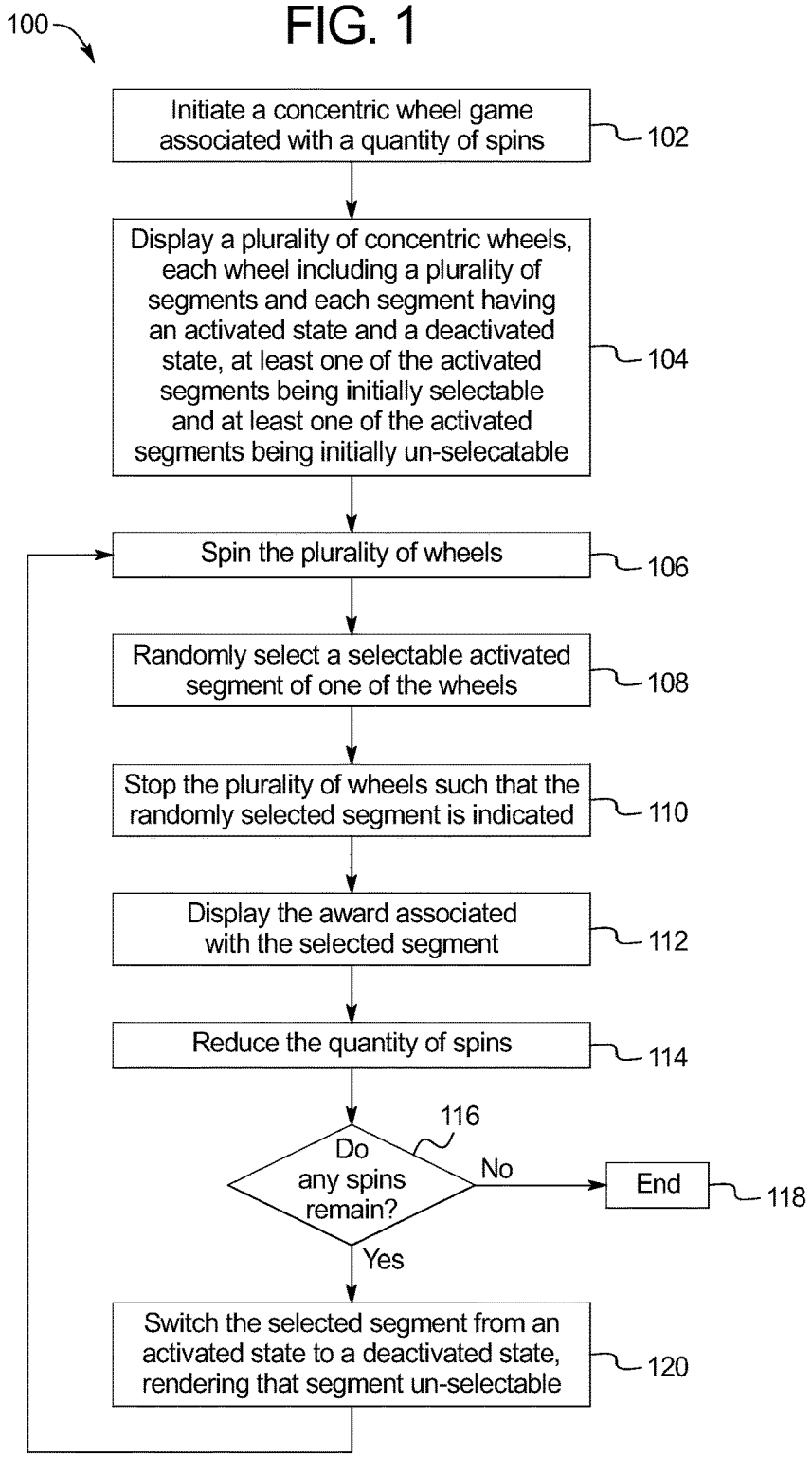
FIG. 1 is a flowchart illustrating an example method of operating one embodiment of the gaming system of the present disclosure.

FIG. 1 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In this example embodiment, the plurality of concentric objects includes a plurality of concentric wheels. In operation of this example embodiment, the gaming system initiates a play of the concentric wheel game, which is associated with a quantity of spins, as indicated by block 102. In various embodiments, the gaming system initiates the play of the concentric wheel game upon an occurrence of a triggering event, such as (but not limited to) a symbol-driven triggering event that occurs during a play of a primary game. Upon initiation of the play of the concentric wheel game, the gaming system displays a plurality of concentric wheels, as indicated by block 104. Each wheel includes a plurality of segments, and each segment has an activated state and a deactivated state. Initially, at least one activated segment is selectable and at least one activated segment is un-selectable. Generally, in this example embodiment, the gaming system can select a selectable activated segment during the play of the concentric wheel game and the gaming system cannot select an un-selectable activated segment or a deactivated segment during the play of the concentric wheel game. Initially, in this embodiment, each segment is in the activated state, and each segment is switchable from the activated state to the deactivated state. Additionally, each segment is associated with an award.

The gaming system spins the plurality of wheels, as indicated by block 106. The gaming system randomly selects a selectable activated segment of one of the wheels, as indicated by block 108. The gaming system stops the plurality of wheels such that the randomly selected segment is indicated, as indicated by block 110. The gaming system displays the award associated with the randomly selected segment, as indicated by block 112.

The gaming system reduces the quantity of spins, as indicated by block 114, and determines whether any spins remain, as indicated by decision diamond 116. If no spins remain, the gaming system ends the play of the concentric wheel game, as indicated by block 118. If, on the other hand, one or more spins remain, the gaming system switches the selected segment from the activated state to the deactivated state, rendering that segment un-selectable during the remainder of the play of the concentric wheel game, as indicated by block 120. The process 100 then returns to block 106, and the gaming system spins the plurality of the wheels again.

In certain embodiments, certain un-selectable activated segments of certain of the plurality of wheels remain un-selectable by the gaming system until the gaming system deactivates one or more activated segments of one or more other wheels. For instance, in one embodiment, the concentric wheel game is associated with a first wheel, a second wheel, and a third wheel. The first wheel completely surrounds the second wheel and the second wheel completely surrounds the third wheel. In this embodiment, the gaming system cannot select any activated segment of the second wheel (i.e., the activated segments of the second wheel are initially un-selectable) until the gaming system has deactivated at least one activated segment of the first wheel. Additionally, in this embodiment, the gaming system cannot select any activated segment of the third wheel (i.e., the activated segments of the third wheel are initially un-selectable) until the gaming system has deactivated at least one activated segment of the first wheel and at least one activated segment of the second wheel. Thus, after the gaming system switches a segment of a first wheel from the activated state to the deactivated state, rendering that segment un-selectable, at least one activated segment of the second wheel is selectable for a second subsequent spin of the plurality of wheels. Put differently, once the gaming system switches a segment of the first wheel from the activated state to the deactivated state, a probability of selecting an activated segment of the second wheel increases (from a probability of 0% to a probability of greater than 0%).

FIGS. 2A, 2B, 2C, 2D, 3A, 3B, 3C, 3D, 4A, 4B, 4C, and 4D are screen shots of the operation of a play of the concentric object game of one example embodiment of the gaming system of the present disclosure. In this example embodiment, the concentric objects are concentric wheels. The concentric wheel game of this embodiment is a bonus game and is associated with a plurality of concentric wheels and a quantity of spins of the wheels. Each wheel includes a plurality of segments, and each segment has an activated state and a deactivated state. In certain embodiments, the wheels have the same quantity of segments, while in other embodiments at least two of the wheels have different quantities of segments. Initially, each segment is in the activated state (and each segment is switchable from the activated state to the deactivated state during the play of the concentric wheel game).

In this example embodiment, for each of the quantity of spins associated with the play of the concentric wheel game, the gaming system spins the plurality of wheels and randomly selects a selectable activated segment of one of the plurality of wheels. In this example embodiment, certain activated segments are initially selectable, while other activated segments are not initially selectable but may become selectable as the gaming system switches other segments to the deactivated state. In other words, these non-initially-selectable segments become selectable once the gaming system switches one or more segments of one or more other wheels from the activated state to the deactivated state. More specifically, the activated segments of an inner wheel are not selectable by the gaming system until at least one segment of each outer wheel surrounding that inner wheel is deactivated.

As shown in FIGS. 2A to 2D, in this example embodiment, the concentric wheel game is associated with five concentric wheels 210, 220, 230, 240, and 250. Each of the wheels includes a plurality of segments. In this embodiment, each segment is associated with an award of a quantity of credits or a multiplier.

More specifically, in this example embodiment, the first wheel 210 includes: (a) a segment 210*a* associated with an award of 100 credits, (b) a segment 210*b* associated with an award of 10 credits, (c) a segment 210*c* associated with an award of 25 credits, (d) a segment 210*d* associated with an award of 75 credits, (e) a segment 210*e* associated with an award of 5 credits, (f) a segment 210*f* associated with an award of 50 credits, (g) a segment 210*g* associated with an award of 25 credits, and (h) a segment 210*h* associated with an award of 50 credits.

The second wheel 220 includes: (a) a segment 220*a* associated with an award of 150 credits, (b) a segment 220*b* associated with an award of 500 credits, (c) a segment 220*c* associated with an award of 150 credits, (d) a segment 220*d* associated with an award of 250 credits, (e) a segment 220*e* associated with an award of 500 credits, (f) a segment 220*f* associated with an award of 300 credits, (g) a segment 220*g* associated with an award of 200 credits, and (h) a segment 220*h* associated with an award of 250 credits.

The third wheel 230 includes: (a) a segment 230*a* associated with an award of 1,000 credits, (b) a segment 230*b* associated with an award of 900 credits, (c) a segment 230*c* associated with an award of 650 credits, (d) a segment 230*d* associated with an award of 700 credits, (e) a segment 230*e* associated with an award of 1,000 credits, (f) a segment 230*f* associated with an award of 850 credits, (g) a segment 230*g* associated with an award of 750 credits, and (h) a segment 230*h* associated with an award of 800 credits.

The fourth wheel 240 includes: (a) a segment 240*a* associated with an award of 4,000 credits, (b) a segment 240*b* associated with an award of 8,000 credits, (c) a segment 240*c* associated with an award of 10,000 credits, (d) a segment 240*d* associated with an award of 2,000 credits, (e) a segment 240*e* associated with an award of 3,000 credits, (f) a segment 240*f* associated with an award of 7,000 credits, (g) a segment 240*g* associated with an award of 5,000 credits, and (h) a segment 240*h* associated with an award of 10,000 credits.

The fifth wheel 250 includes: (a) a segment 250*a* associated with an award of a 4× multiplier, (b) a segment 250*b* associated with an award of a 5× multiplier, (c) a segment 250*c* associated with an award of a 2× multiplier, (d) a segment 250*d* associated with an award of a 5× multiplier, (e) a segment 250*e* associated with an award of a 2× multiplier, (f) a segment 250*f* associated with an award of a 3× multiplier, (g) a segment 250*g* associated with an award of a 10× multiplier, and (h) a segment 250*h* associated with an award of a 2× multiplier.

The first wheel 210 completely surrounds the second wheel 220, the second wheel 220 completely surrounds the third wheel 230, the third wheel 230 completely surrounds the fourth wheel 240, and the fourth wheel 240 completely surrounds the fifth wheel 250. In this example embodiment, the gaming system cannot select any activated segment of a wheel surrounded by one or more other wheels until the gaming system deactivates at least one segment of each of surrounding wheel. As such, in this example embodiment: (1) the activated segments of the second wheel 220 are un-selectable (i.e., the gaming system cannot select any activated segment of the second wheel 220) until the gaming system deactivates at least one segment of the first wheel 210; (2) the activated segments of the third wheel 230 are un-selectable (i.e., the gaming system cannot select any activated segment of the third wheel 230) until the gaming system deactivates at least one segment of each of the first wheel 210 and the second wheel 220; (3) the activated segments of the fourth wheel 240 are un-selectable (i.e., the gaming system cannot select any activated segment of the fourth wheel 240) until the gaming system deactivates at least one segment of each of the first wheel 210, the second wheel 220, and the third wheel 230; and (5) the activated segments of the fifth wheel 250 are un-selectable (i.e., the gaming system cannot select any activated segment of the fifth wheel 250) until the gaming system deactivates at least one segment of each of the first wheel 210, the second wheel 220, the third wheel 230, and the fourth wheel 240.

Figure 2A:
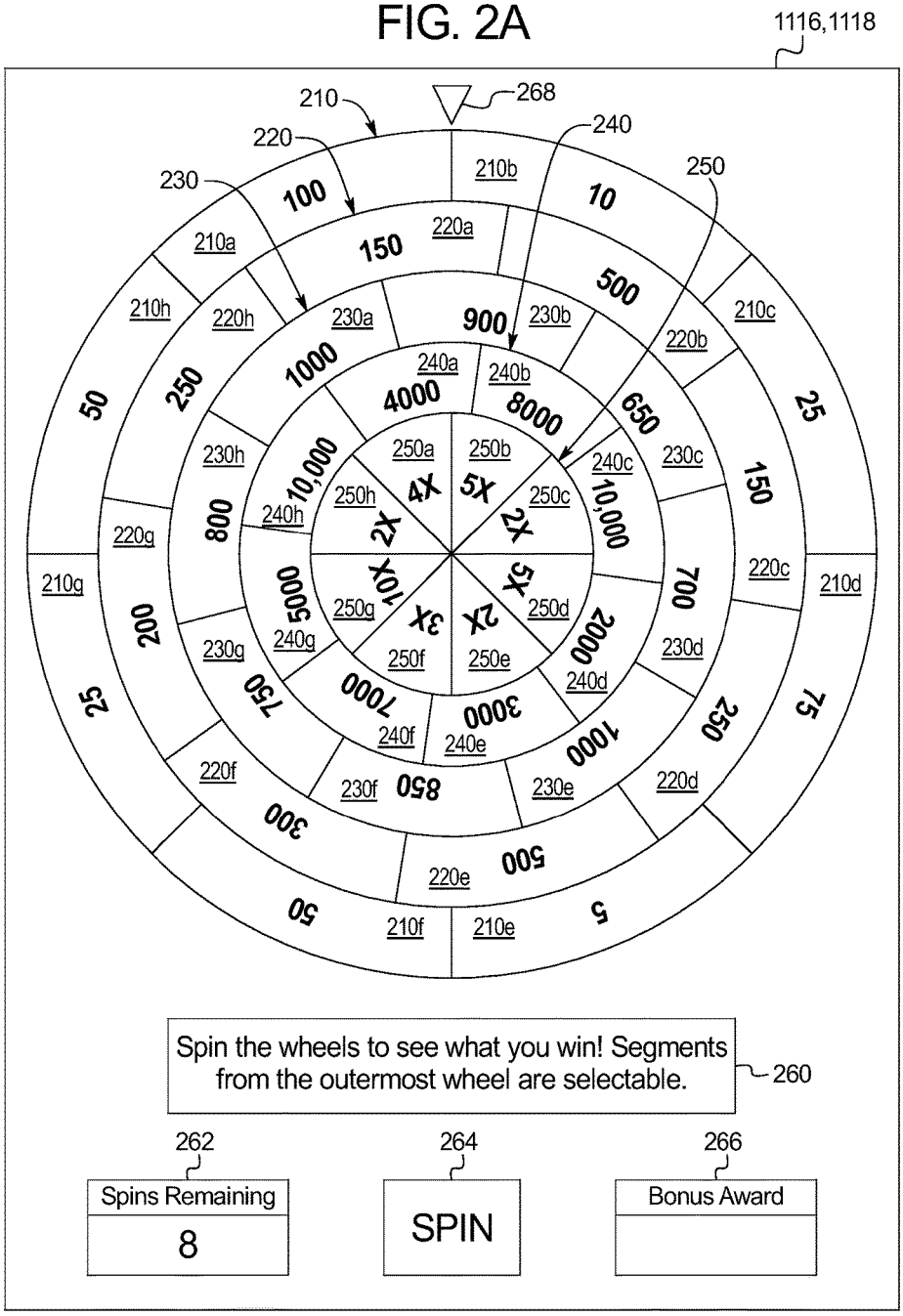
FIGS. 2A, 2B, 2C, 2D, 3A, 3B, 3C, 3D, 4A, 4B, 4C, and 4D illustrate screen shots showing the operation of a play of the concentric object game of one example embodiment of the gaming system of the present disclosure.

Turning to FIG. 2A, upon initiation of the play of the concentric wheel game in this example embodiment, the gaming system displays, such as on a display device 1116 or 1118 (described below), the plurality of concentric wheels 210, 220, 230, 240, and 250. The gaming system also displays: (i) a spins remaining meter 262 that displays the quantity of spins remaining for the play of the concentric wheel game; and (ii) a spin button 264 that, when actuated by a player, causes the gaming system to spin the plurality of concentric wheels and causes the gaming system to decrease the quantity of spins remaining by a designated quantity (such as 1 spin). The gaming system also displays a bonus award meter 266 that displays any awards won during the play of the concentric wheel game (in credit or currency form). While any credit balances, any wagers, and any awards are displayed as amounts of monetary currency or credits in this example embodiment, one or more of such credit balances, such wagers, and such awards may be for any suitable non-monetary credits or currency, promotional credits, and/or player tracking points or credits. The gaming system also displays a message box 260 and an indicator 268 that indicates at least one segment of the plurality of wheels.

In operation, as described above, each segment is initially in the activated state, and for the first spin of the plurality of wheels, only the segments of the first wheel 210 are selectable. In this example embodiment, as indicated by the spins remaining meter 262, the play of the concentric wheel game is initially associated with a quantity of 8 spins. The gaming system displays the following message in the message box 260: "SPIN THE WHEELS TO SEE WHAT YOU WIN! SEGMENTS FROM THE OUTERMOST WHEEL ARE SELECTABLE!"

Figure 2B:
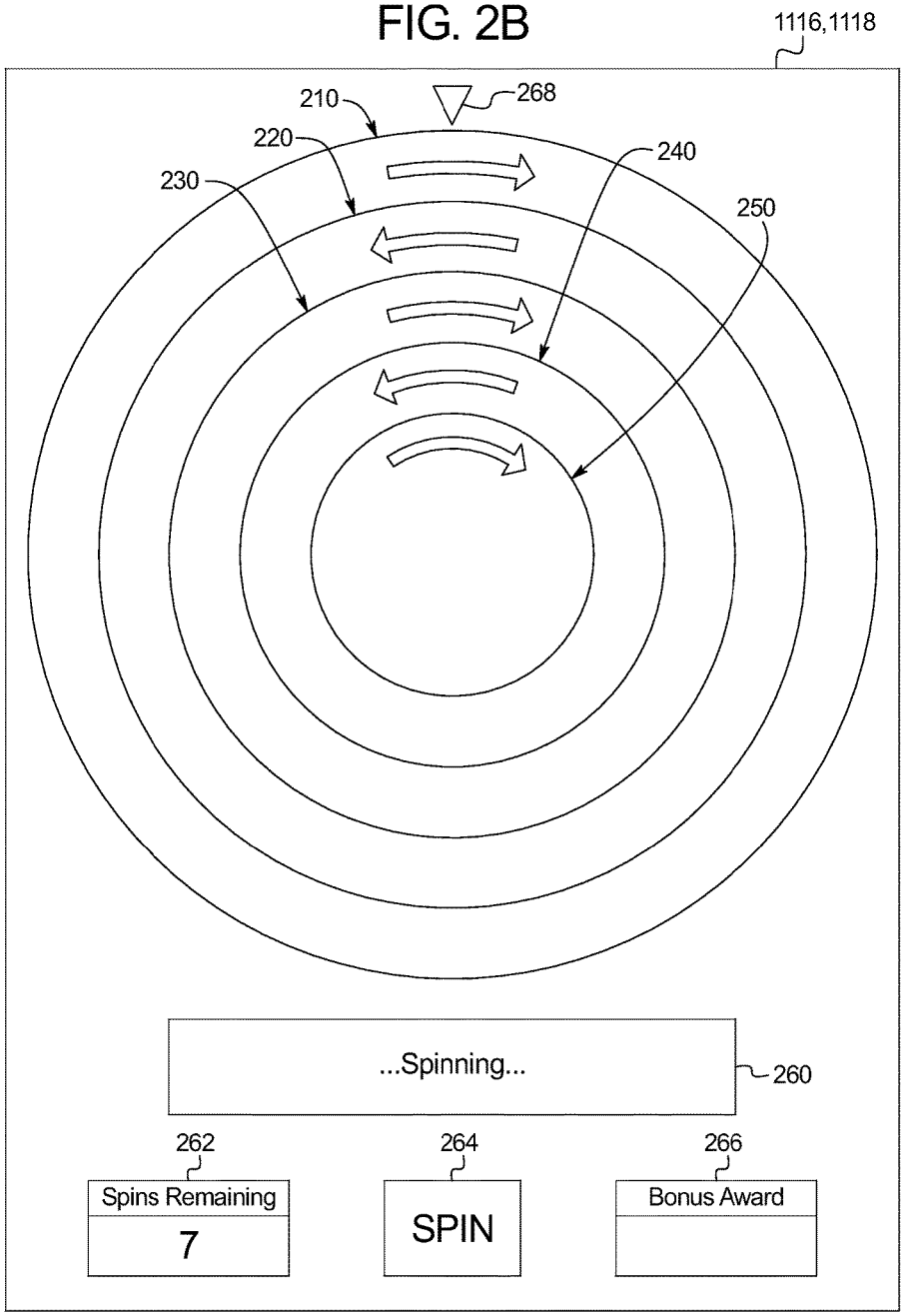

As shown in FIG. 2B, after receiving an actuation of the spin button 264, the gaming system spins the plurality of wheels. The gaming system decreases the quantity of spins remaining to 7 spins, as indicated by the spins remaining meter 262. In this example embodiment, each of the plurality of wheels 210, 220, 230, 240, and 250 spins in a different direction from the wheel(s) adjacent to it. In various embodiments, each of the plurality of wheels spins independent of the other wheels. In certain embodiments, at least two of the plurality of wheels spin at different speeds. In other embodiments, the plurality of wheels each spin in the same direction at different speeds. In another embodiment, the plurality of wheels each spin together in the same direction at the same speed. As depicted in FIG. 2B, in this example embodiment, the gaming system displays the following message in the message box 260: " . . . SPINNING . . . "

Figure 2C:
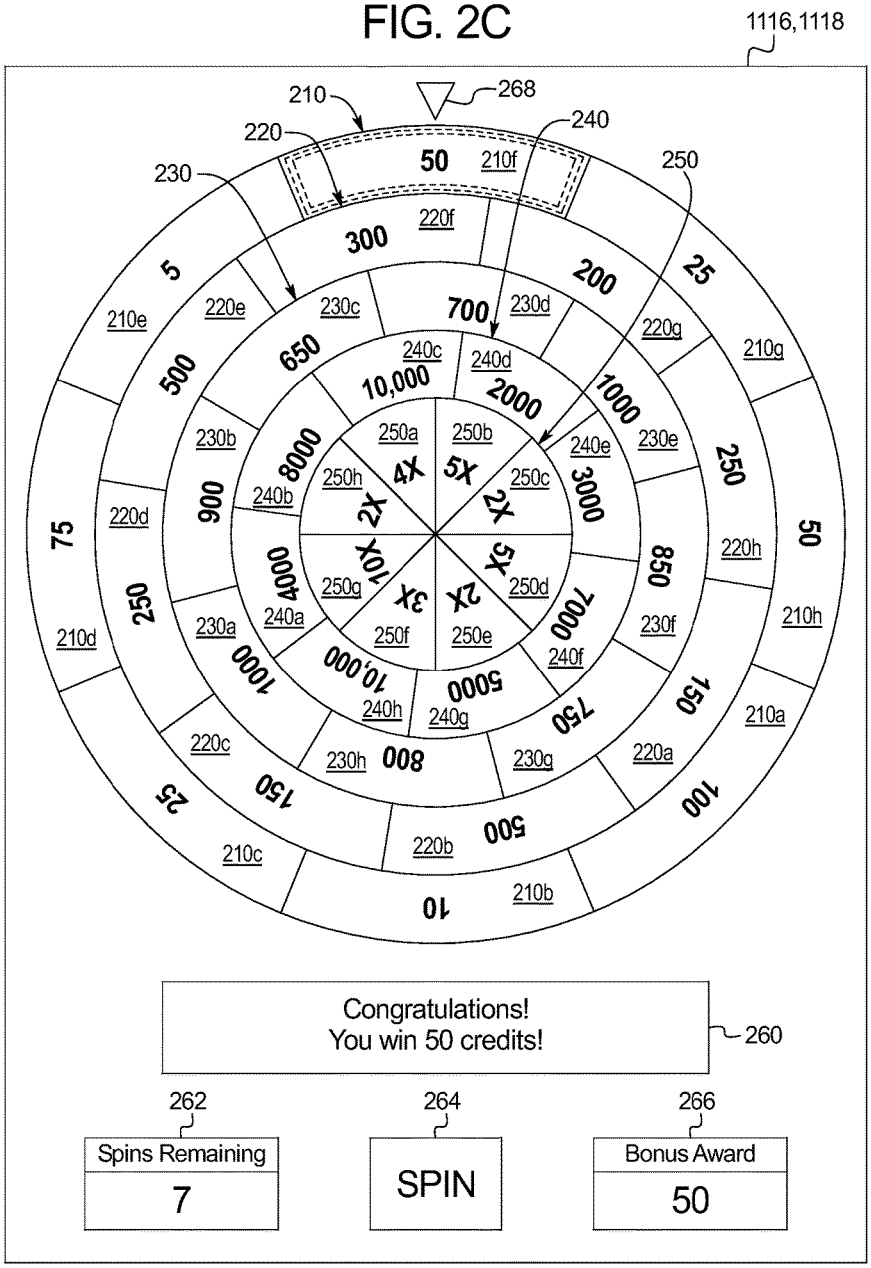

The gaming system randomly selects one of the selectable activated segments of one of the plurality of wheels (i.e., at this point, one of the activated segments of the first wheel 210). As shown in FIG. 2C, once the gaming system randomly selects a selectable activated segment, the gaming system stops the plurality of wheels such that the indicator 268 indicates the randomly selected segment. In this example embodiment, the gaming system randomly selects and indicates segment 210*f*, which is associated with an award of 50 credits. The gaming system displays the 50 credit award in the bonus award meter 266, and displays the following message in the message box 260: "CONGRATULATIONS! YOU WIN 50 CREDITS!"

Figure 2D:
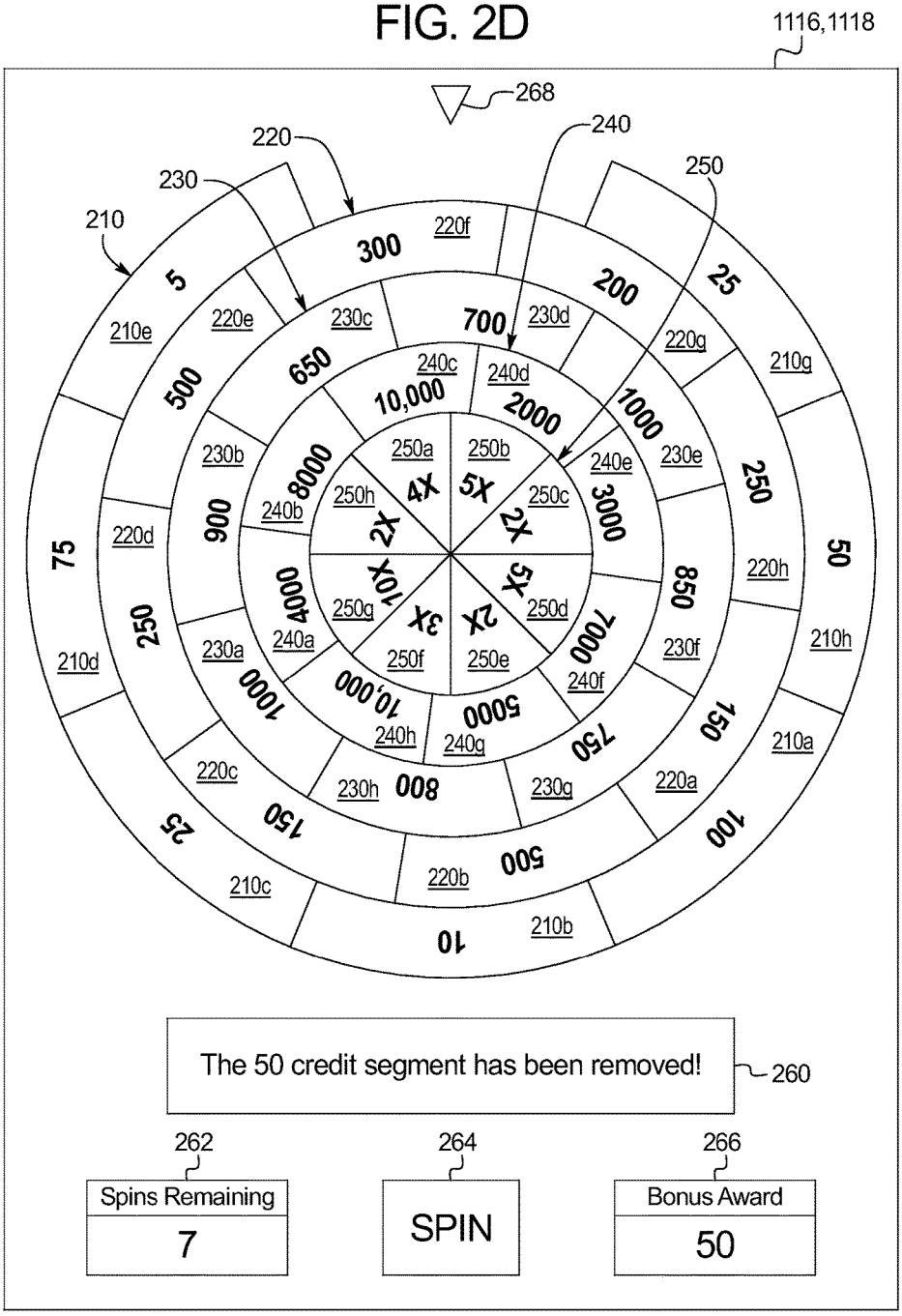

After displaying the award associated with the selected segment, since at least one spin remains, the gaming system switches the selected segment from the activated state to the deactivated state, rendering that segment un-selectable for the remainder of the play of the concentric wheel game. In this example embodiment, the gaming system indicates that the selected segment is deactivated by removing the selected segment from the corresponding wheel. Here, as shown in FIG. 2D, the gaming system removes segment 210*f* from wheel 210 and the gaming system displays the following message in the message box 260: "THE 50 CREDIT SEGMENT HAS BEEN REMOVED!"

By removing the selected segment 210*f* from the first wheel 210, the gaming system creates an opening in the first wheel 210. This opening in the first wheel 210 permits access to the segments of the second wheel 220. Accordingly, for the subsequent spins of the play of the concentric wheel game, the activated segments of the second wheel 220 are now selectable along with the segments of the first wheel 210. Since the gaming system has not removed any segments of the second wheel 220, the activated segments of the third wheel 230, the fourth wheel 240, and the fifth wheel 250 remain un-selectable.

FIGS. 3A to 3D illustrate screen shots showing the operation of a subsequent second activation of the plurality of wheels. The gaming system displays the following message in the message box 260: "SEGMENTS FROM THE OUTERMOST TWO WHEELS ARE NOW SELECTABLE! SPIN AGAIN TO SEE WHAT YOU WIN!"

Figure 3A:
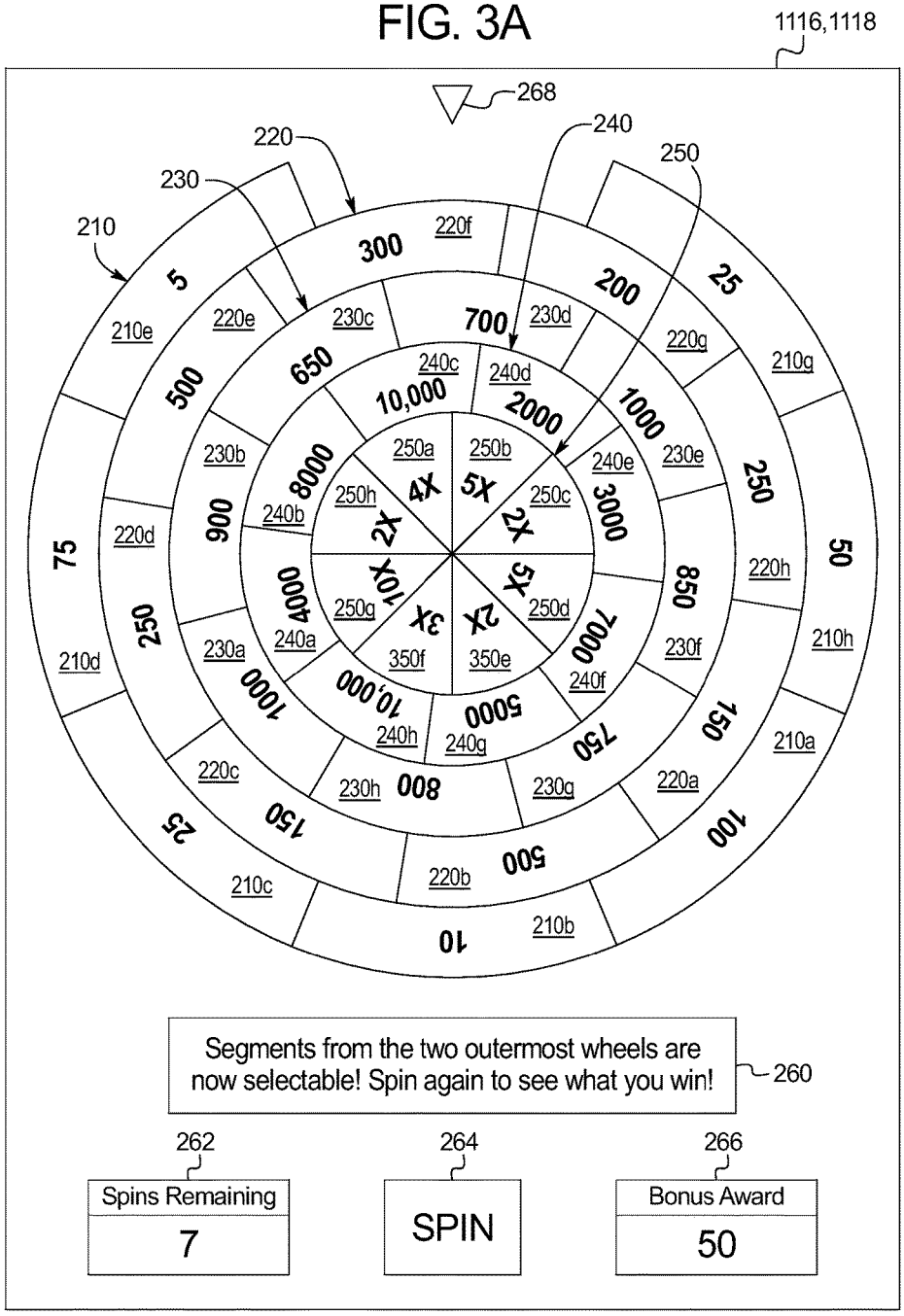
Figure 3B:
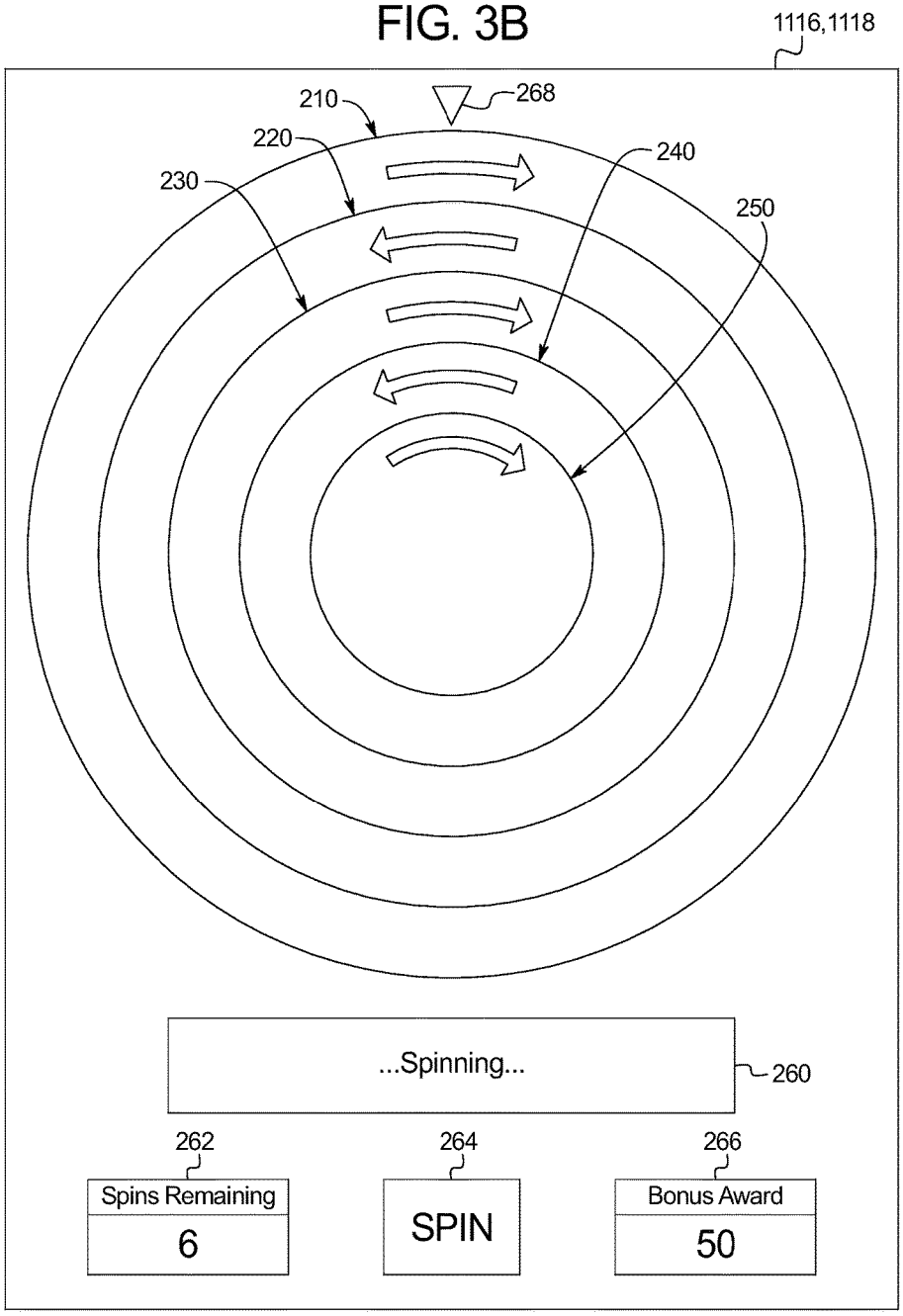

As shown in FIG. 3B, after receiving the actuation of the spin button 264, the gaming system spins the plurality of wheels. The gaming system decreases the quantity of spins remaining to 6 spins, as indicated by the spins remaining meter 262. The gaming system displays the following message in the message box 260: " . . . SPINNING . . . "

Figure 3C:
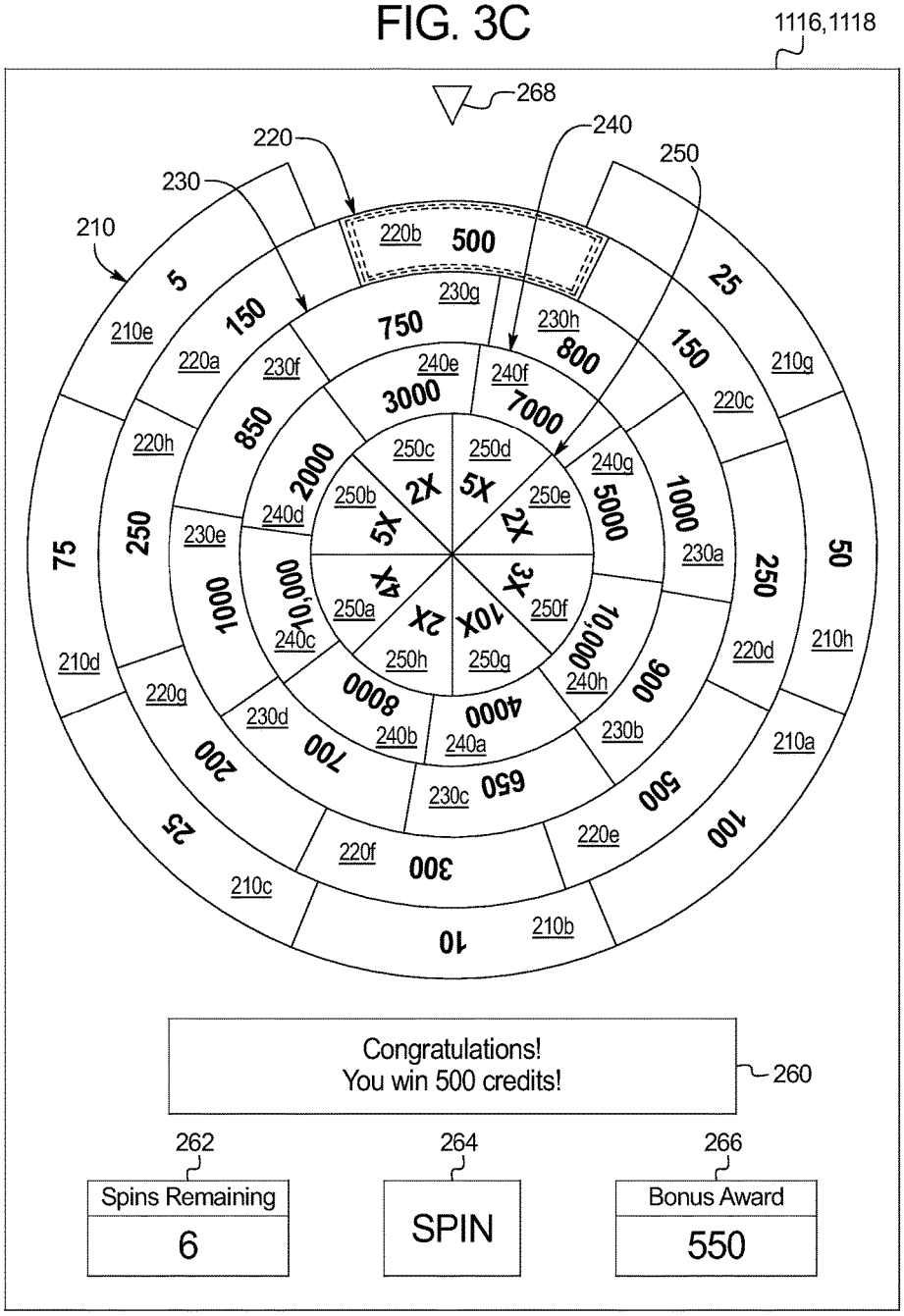

The gaming system randomly selects one of the selectable activated segments of one of the plurality of wheels (i.e., at this point, one of the activated segments of the first wheel 210 and the second wheel 220). As shown in FIG. 3C, once the gaming system randomly selects a selectable activated segment, the gaming system stops the plurality of wheels such that the indicator 268 indicates the randomly selected segment. In this example embodiment, the gaming system randomly selects and indicates segment 220*b*, which is associated with an award of 500 credits. The gaming system adds the 500 credits to the bonus award and displays a total bonus award of 550 credits in the bonus award meter 266. The gaming system displays the following message in the message box 260: "CONGRATULATIONS! YOU WIN 500 CREDITS!"

Figure 3D:
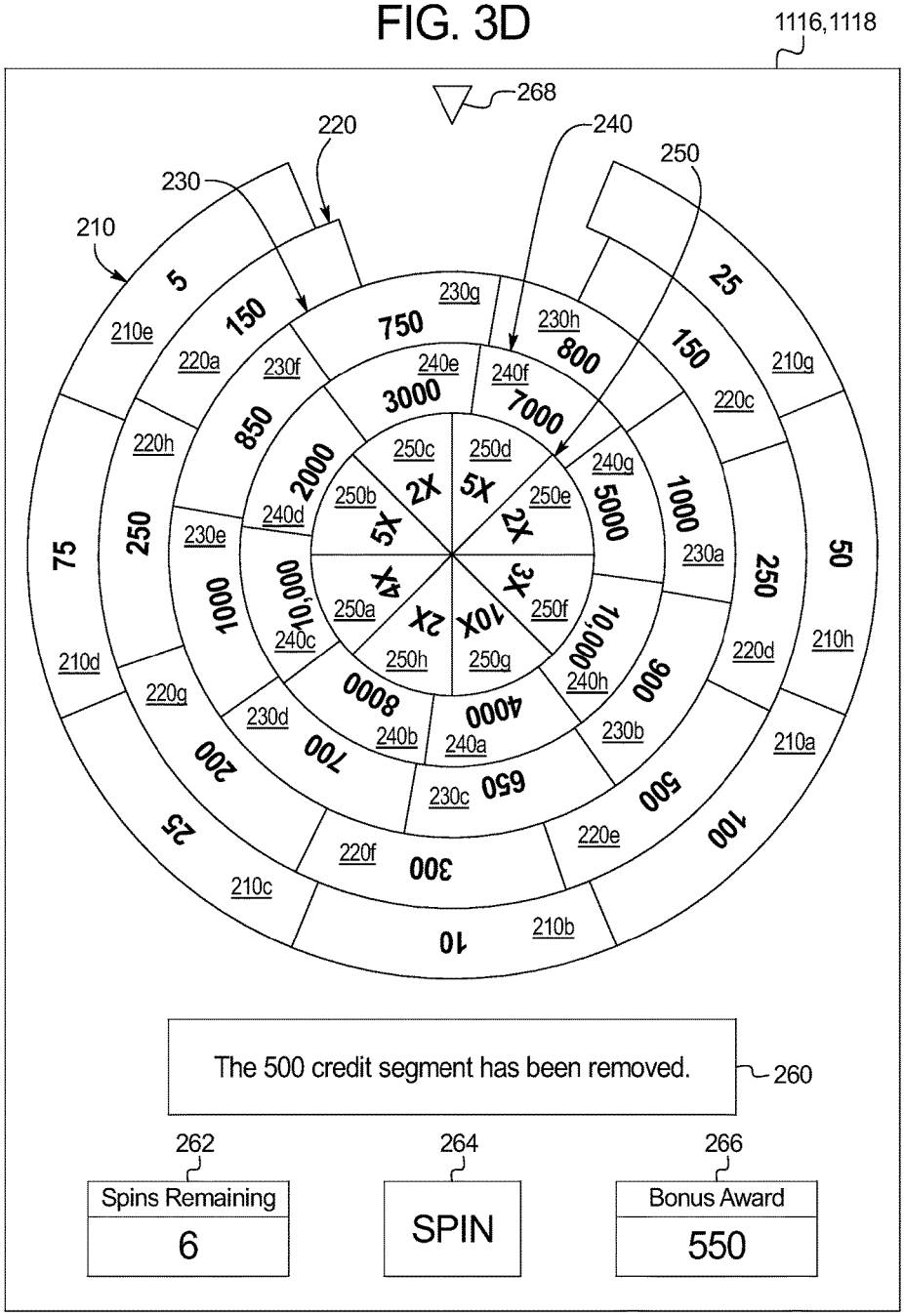

After displaying the award associated with the selected segment 220*b*, since at least one spin remains, the gaming system switches the selected segment from the activated state to the deactivated state, rendering that segment un-selectable for the remainder of the play of the concentric wheel game. The gaming system indicates that the selected segment is deactivated by removing the selected segment from the corresponding wheel. Here, as shown in FIG. 3D, the gaming system removes segment 220*b* from wheel 220 and the gaming system displays the following message in the message box 260: "THE 500 CREDIT SEGMENT HAS BEEN REMOVED!"

By removing the selected segment 220*b* from the second wheel 220, the gaming system creates an opening in the second wheel 220. The opening in the first wheel 210 and the new opening in the second wheel 220, together permit access to the segments of the third wheel 230. Accordingly, for the subsequent spins of the play of the concentric wheel game, the activated segments of the third wheel 230 are now selectable.

FIGS. 4A to 4D illustrate screen shots showing the operation of a subsequent, eighth activation of the plurality of wheels. Accordingly, the gaming system displays 1 spin remaining as indicated by the spins remaining meter 262. For each of the previous seven spins (or activations), the gaming system randomly selected seven segments and subsequently deactivated the seven segments by removing them from the display of the plurality of wheels, rendering them un-selectable. The seven removed segments include: (i) segment 210*f* associated with an award of 50 credits; (ii) segment 210*c* associated with an award of 25 credits; (iii) segment 210*h* associated with an award of 50 credits; (iv) segment 220*b* associated with an award of 500 credits; (v) segment 220*f* associated with an award of 300 credits; (vi) segment 230*a* associated with an award of 1,000 credits; and (vii) and segment 240*c* associated with an award of 10,000 credits. The gaming system displays the total award of 11,925 credits in the bonus award meter 266.

Since, the gaming system removed at least one segment from each of the four outer wheels 210, 220, 230, and 240, activated segments from all wheels, including the fifth wheel 250, are now selectable. The gaming system displays the following message in the message box 260: "SEGMENTS FROM ALL WHEELS ARE NOW SELECTABLE! SPIN AGAIN TO SEE WHAT YOU WIN!"

Figure 4A:
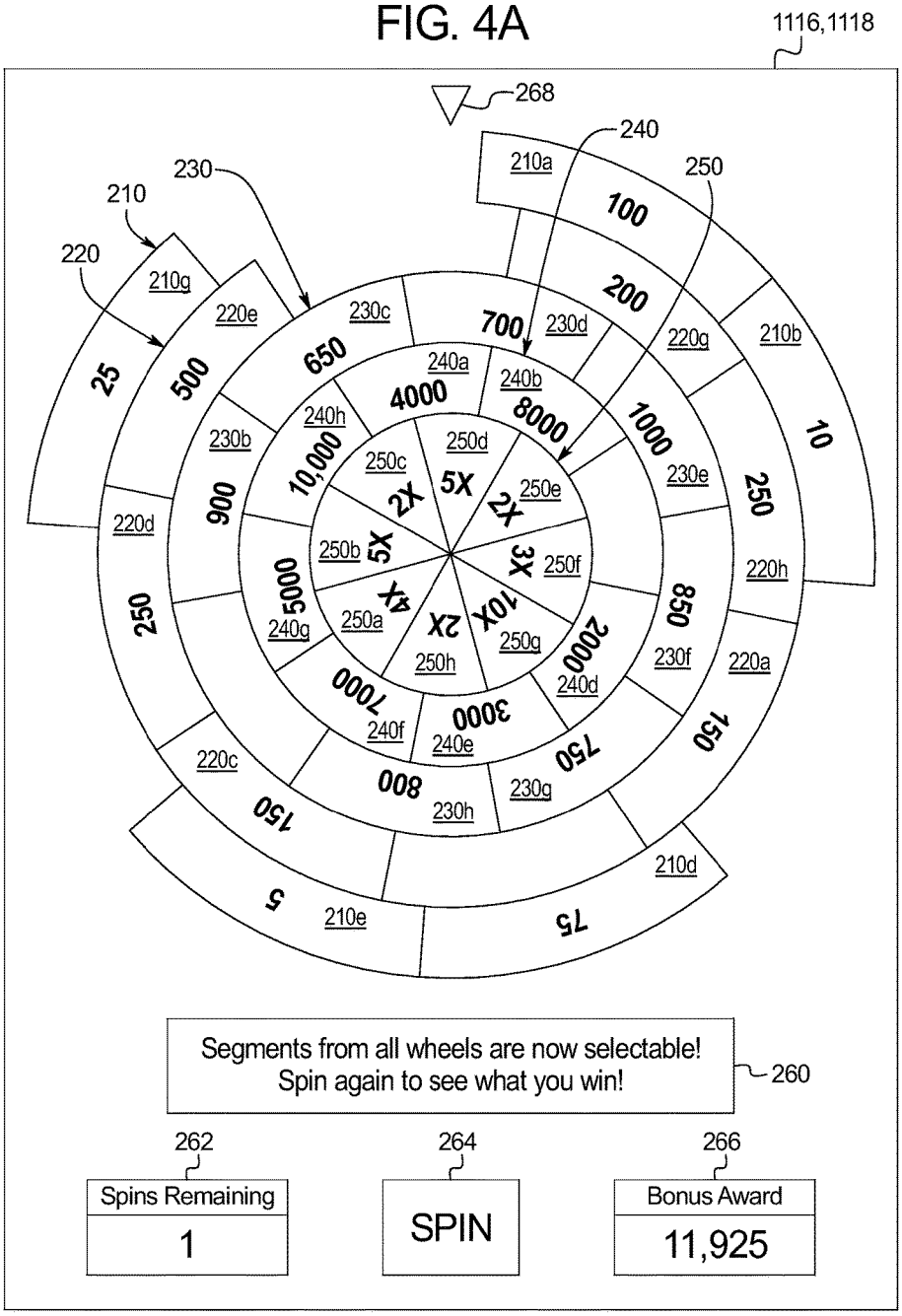
Figure 4B:
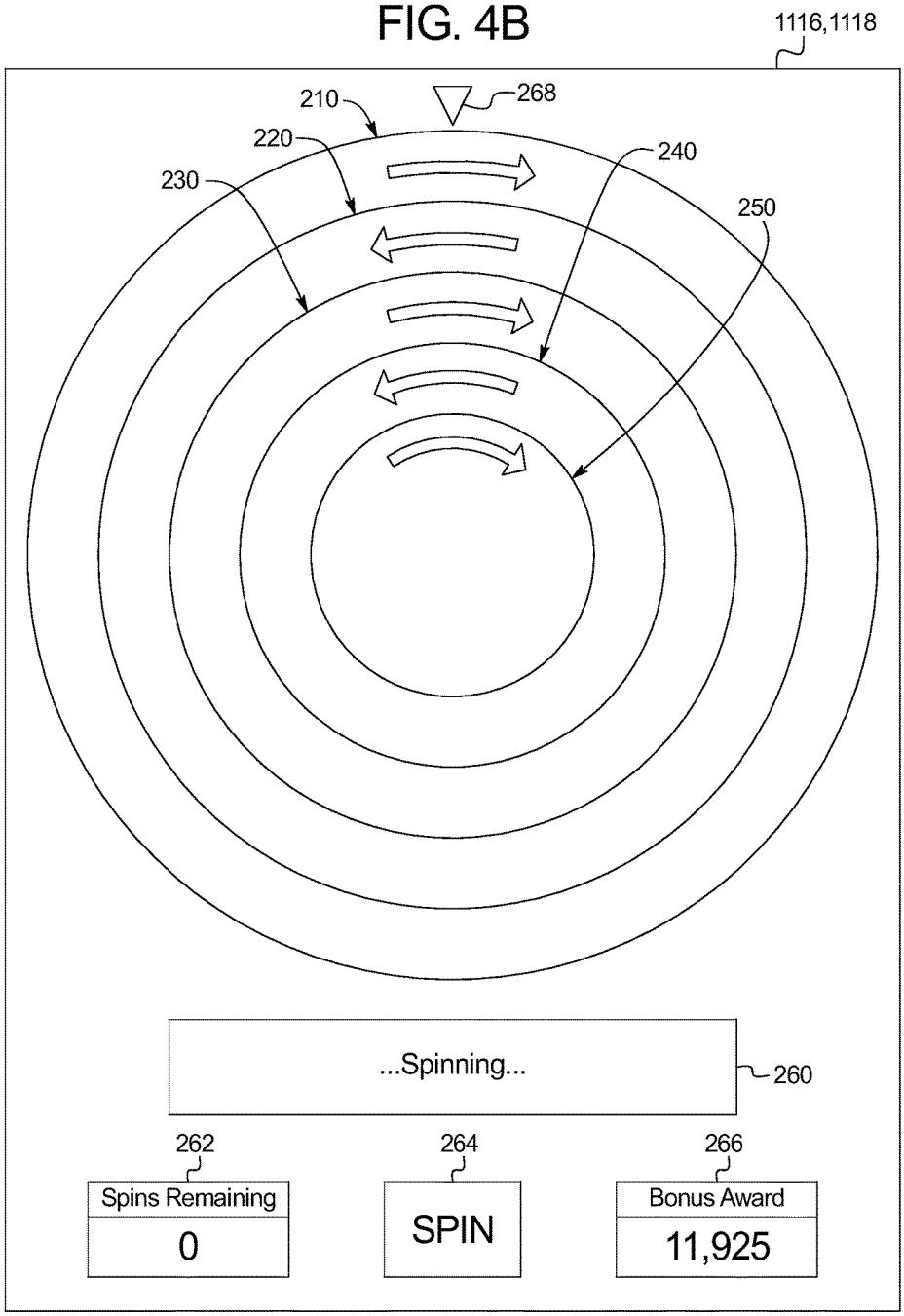

As shown in FIG. 4B, after receiving the actuation of the spin button 264, the gaming system spins the plurality of wheels. The quantity of spins remaining decreases to 0 spins remaining as indicated by the spins remaining meter 262. The gaming system displays the following message in the message box 260: " . . . SPINNING . . . "

Figure 4C:
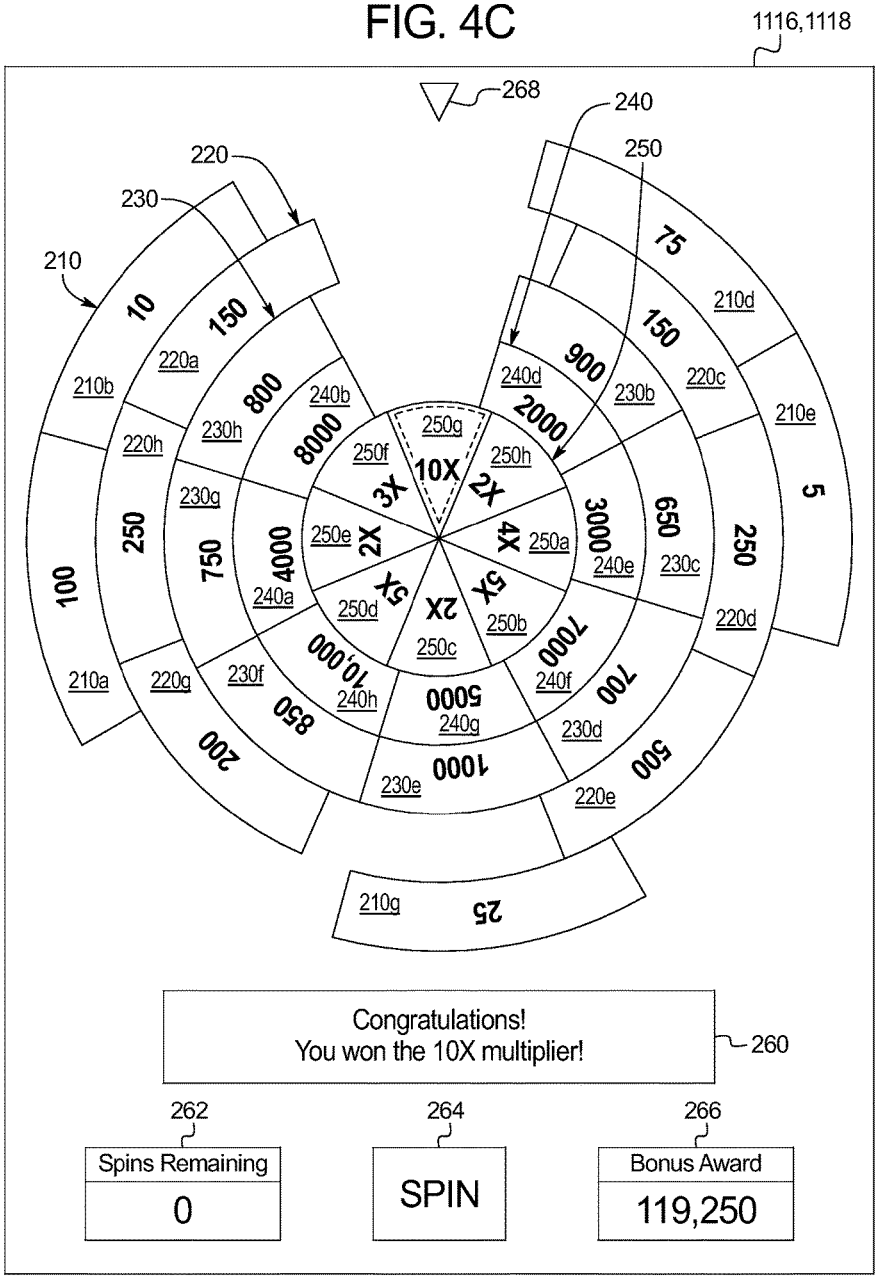
Figure 4D:
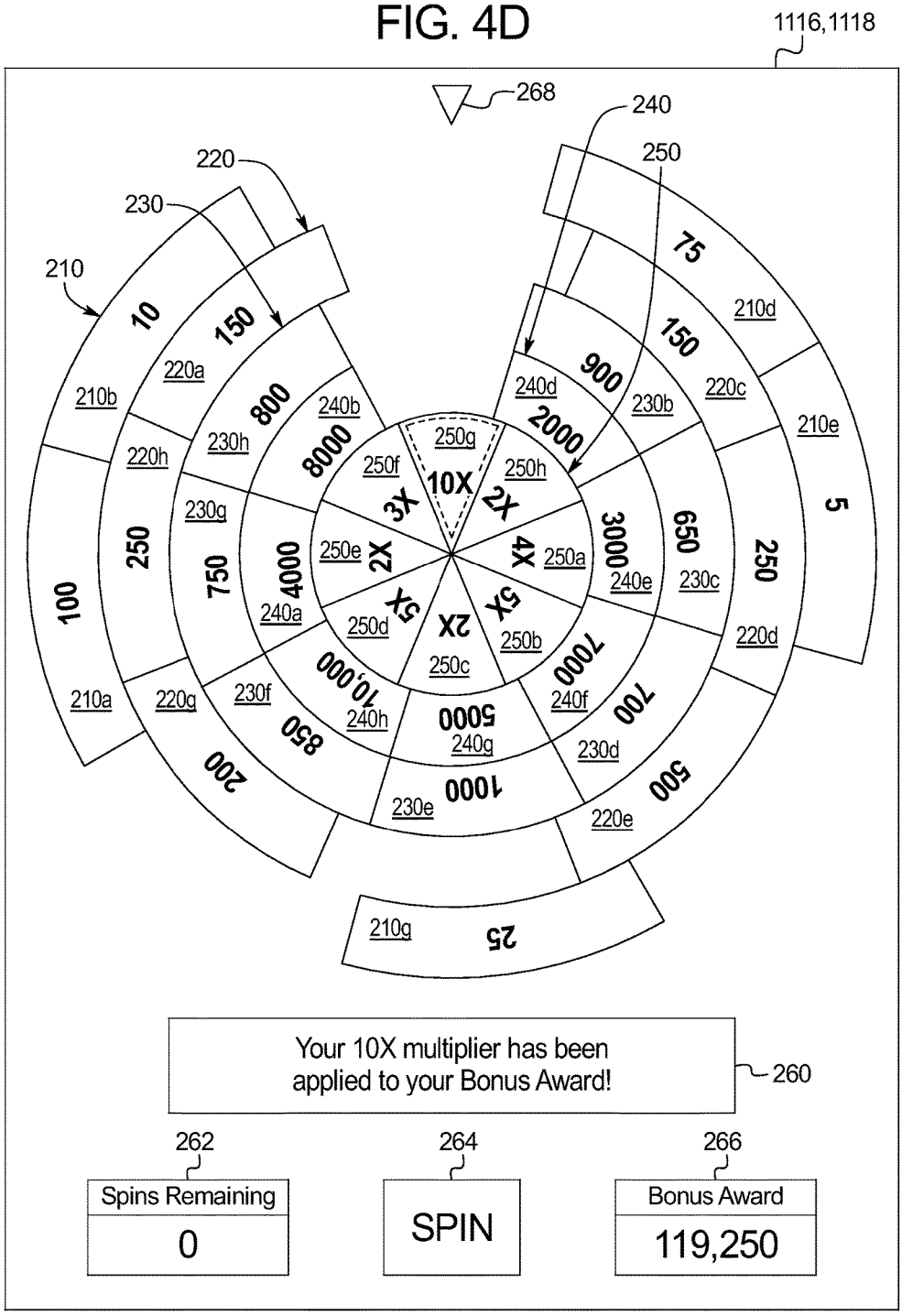

The gaming system randomly selects one of the selectable activated segment of one of the plurality of wheels (i.e., at this point, one of the activated segments of any of the wheels). As shown in FIG. 4C, once the gaming system randomly selects the selectable activated segment, the gaming system stops the plurality of wheels such that the indicator 268 indicates the randomly selected segment. In this example embodiment, the gaming system randomly selects and indicates segment 250*g*, which is associated with an award of a 10× multiplier. The gaming system displays the following message in the message box 260: "CONGRATULATIONS! YOU WIN the 10× MULTIPLIER!"

The gaming system applies the 10× multiplier to the previous bonus award total of 11,925. Accordingly, in FIG. 4D, the gaming system displays the total 119,250 credit award in the bonus award meter 266. The gaming system displays the following message in the message box 260: "YOUR 10× MULTIPLIER HAS BEEN APPLIED TO YOUR BONUS AWARD!" After displaying the award associated with the selected segment, since no spins remain, the gaming system ends the play of the concentric wheel game.

In this example embodiment, the gaming system applies the modifier associated with segment 250*g* to the total previous award. In another embodiment, the gaming system provides the modifier to the award associated with the previous spin or with an award associated with a subsequent spin. In another embodiment, the gaming system applies the modifier to an award of a primary game.

In certain embodiments, such as the example embodiment described above, the award values associated with the plurality of segments are increasingly more valuable, on average, moving from the outer wheel to the inner wheel. With each subsequent spin of the plurality of wheels, the likelihood that the gaming system will select and remove segments of the outer wheels to permit access to the more lucrative inner wheels increases. Accordingly, the probably of selecting one of the more valuable awards increases with each subsequent spin. Thus, the player's anticipation builds with each spin and so does the player's excitement and enjoyment.

In certain embodiments, the first wheel is the inner most wheel and the award values associated with the plurality of segments are increasingly more valuable for each outer wheel. In one example embodiment, initially all of the segments are activated and only the segments of the inner most wheel are selectable. The activated segments of the outer wheels remain un-selectable by the gaming system until the gaming system deactivates one or more segments of the inner wheel, rendering it un-selectable for a subsequent spin of the play of the concentric wheel game. In other words, in these embodiments, the play of the concentric wheel game proceeds from the inner wheel outward instead of the outer wheel inward.

In the embodiment described above, the plurality of concentric objects are wheels. In other embodiments, the plurality of concentric objects take any other suitable shape or shapes. In one example embodiment, the plurality of concentric objects includes a plurality of concentric squares. In this example embodiment, each of the plurality of squares includes a plurality of segments that can switch from an activated state to a deactivated state. For a play of the concentric square game in this example embodiment, the gaming system spins the squares a plurality of times and, for each spin: selects a selectable activated segment of one of the squares, provides any award associated with the selected segment, and deactivates the selected segment such that the selected segment is not selectable for the remainder of the play of the concentric square game.

In various embodiments, the gaming system includes a plurality of lighting devices that illuminate that the gaming system uses to randomly select a selectable activated segment of one of the plurality of concentric objects. In one example embodiment, the lighting devices consecutively illuminate each of the segments of the plurality of concentric objects in a clockwise or counter-clockwise direction to trace around the plurality of concentric objects. The gaming system of this example embodiment stops the light at the randomly selected segment. The gaming system may employ any other suitable manner of indicating the randomly selected object.

In various embodiments, the duration of each play of the concentric object game may include any suitable period, such as (but not limited to) a period of time, or a quantity of spins. In the example embodiment described above, the duration of the play of the concentric wheel game is for a quantity of 8 spins. In another embodiment, the gaming system provides an unlimited quantity of spins for a designated period of time. Thus, in such an embodiment, the player has an incentive to play quickly and make as many actuations of the spin button as possible during the period of time. In another embodiment, the duration of the game is a quantity of deactivations. More specifically, in one example embodiment, the duration of the game is for the period in which the gaming system deactivates a designated quantity of segments.

In certain embodiments, the period (i.e., the period of time, the quantity of spins or the quantity of durations) is predetermined. In other embodiments, the period is randomly determined. In another embodiment, the gaming system determines the period based on an initial wager amount. In certain embodiments, the gaming system ends the play of the concentric wheel game upon a termination event, such as the indication of a particular termination segment. In other words, the gaming system provides unlimited wheel spins until the indication of the termination segment.

In certain embodiments, the play of the concentric object game is a persistence game in which the gaming system maintains the state of the plurality of objects (i.e., which segments the gaming system has deactivated, rendering them un-selectable, and which segments are still activated and selectable) from spin to spin, regardless of which particular player is playing at any point in time. In other embodiments, the play of the concentric object game is a personal persistence game in which the gaming system maintains the state of the plurality of objects (i.e., which segments the gaming system has deactivated, rendering them un-selectable, and which segments are still activated and selectable) from for a particular player from play to play and gaming session to gaming session. In such a personal persistence embodiment, the gaming system may store the state of the play of the concentric object game in association with the player's player tracking account. In another embodiment, the play of the concentric object game is persistent only within a gaming session (e.g., until the player cashes out of the gaming system or runs out of credits). In other words, in such an embodiment, the gaming system resets the concentric object game upon termination of a gaming session.

In the embodiment described above, each of the plurality of wheel segments has an activated state and a deactivated state during the play of the concentric wheel game, and each segment is switchable from the activated state to the deactivated state. In another embodiment, certain segments of the concentric objects are non-switchable from the activated state to the deactivated state during the play of the concentric object game. In one example of this embodiment, the segments of the inner most concentric object are always in an activated state. More specifically, in this example embodiment, if the gaming system indicates a non-switchable segment, the gaming system displays the award associated with the selected segment but does not switch the segment from the activated state to the deactivated state for a subsequent spin. In this example embodiment, the gaming system may indicate the non-switchable segment multiple times during the play of the concentric object game. In another embodiment, the gaming system spins the plurality of concentric objects until the gaming system indicates a non-switchable segment, and ends the play of the concentric object game after indicating the non-switchable segment.

In another embodiment, the gaming system must select a segment a designated quantity of times before switching the selected segment from the activated state to the deactivated state. More specifically, in this embodiment, certain segments are associated with a designated quantity of selections prior to deactivation. In an example of this embodiment, a segment is associated with a designated quantity of three selections prior to deactivation. In this example embodiment, the first time that the gaming system selects this segment, the gaming system awards the player the award associated with the selected segment, but the gaming system does not switch the selected segment from the activated state to the deactivated state. In this example embodiment, the second time the gaming system selects the segment, the gaming system awards the player the award associated with the selected segment, but does not switch the segment from the activated state to the deactivated state. After the third time the gaming system selects the segment, the gaming system awards the player the award associated with the indicated segment and the gaming system switches the indicated segment from the activated state to the deactivated state. Thus, in this example embodiment, the gaming system enables the player to receive the award associated with the segment three times before the gaming system deactivates the segment for the remainder of the play of the concentric object game.

In other embodiments, the gaming system may re-activate a deactivated segment. For instance, in one such embodiment, the gaming system may randomly determine to re-activate a deactivated segment. In another such embodiment, the gaming system re-activates a deactivated segment upon an occurrence of a triggering event, such as a particular outcome of a wheel spin (e.g., a re-activation segment is indicated following the wheel spin).

In the embodiment described above, when the gaming system switches a segment from the activated state to the deactivated state, the gaming system removes the segment from the display of the corresponding object. In other embodiments, the gaming system indicates the segment is deactivated without removing the segment from the display of the corresponding object. For instance, in one embodiment, the gaming system displays all activated segments in one color, and displays all deactivated segments in another color. In another embodiment, the gaming system displays the activated segments with the associated award, and the deactivated segments as blank (i.e., without any associated award). In another embodiment, the gaming system highlights each activated segment, such as by making the activated segment blink or by fading the deactivated segments.

In the example embodiment described above, the gaming system displays the plurality of concentric wheels on a display of the gaming system. In another embodiment, the gaming system includes a plurality of mechanical objects, such as wheels, for the play of the concentric object game. In one embodiment, the housing of the gaming system supports a plurality of mechanical wheels, and each of the plurality of mechanical wheels includes a plurality of segments. In one example embodiment, each of the plurality of segments of the mechanical wheels is removable. In this example embodiment, each of the segments is initially in the activated state, at least one activated segment is selectable, and at least one activated segment is un-selectable. In this example embodiment, only the segments of the first (outermost) wheel are selectable. A player spins the plurality of mechanical wheels and once the wheels stop, an indicator indicates a selected segment of the first wheel. The gaming system awards the player the award associated with the selected segment. The gaming system switches the selected segment from the activated state to the deactivated state by removing the selected segment from the mechanical wheel, and thereby renders the selected segment un-selectable for a subsequent spin of the play of the concentric wheel game. By removing the selected segment from the first wheel, the gaming system creates an opening in the first wheel. This opening in the first wheel permits access to the segments of a second wheel. Accordingly, for the subsequent spins of the play of the concentric wheel game, activated segments of the second wheel are now selectable along with the segments of the first wheel.

In another example embodiment including mechanical wheels, the housing of the gaming system also supports a plurality of lighting devices. In this example embodiment, the one or more lighting devices are associated with the segments of the mechanical wheels and illuminate a segment when that segment is in the activated state. When the gaming system switches the segment from the activated state to the deactivated state, the lighting device no longer illuminates the selected segment. In another embodiment, the lighting devices illuminate an activated segment with brighter lighting than a deactivated segment.

In the embodiment described above, all segments are initially in the activated state and are switchable from the activated state to the deactivated state during the play of the concentric object game. In another embodiment, certain segments are initially in the deactivated state and are switchable from the deactivated state to the activated state during the play of the concentric object game. In an example of this embodiment, the plurality of concentric objects includes a plurality of wheels. In this example embodiment, for the first spin of the play of the concentric wheel game, the gaming system designates half of the segments of the first wheel to be in the activated state. The gaming system randomly determines which of the plurality of segments of the first wheel are in the activated state and which of the plurality of segments of the first wheel are in the deactivated state (rendering the deactivated segments un-selectable for the first spin of the wheels). In this example embodiment, the gaming system switches unselected segments from the activated state to the deactivated state and vice-versa for each spin of the play of the concentric wheel game. Thus, in such embodiments, the gaming system provides an added element of surprise and excitement as the activated segments are not the same for each spin.

In various embodiments, the gaming system selects multiple segments for each spin of the play of the concentric object game. More specifically, in the example embodiments described above, the gaming system randomly selects a single segment for each spin of the play of the concentric wheel game, and a single indicator indicates the selected segment. In another embodiment, the gaming system includes multiple indicators and selects multiple segments for each spin of the plurality of concentric objects. In one example embodiment, the gaming system includes two indicators and for each spin, the gaming system indicates two segments. In this example embodiment, the gaming system provides the awards associated with both of the selected segments to the player. In this example embodiment, the gaming system switches both of the selected segments from the activated state to the deactivated state, rendering both of the selected segments un-selectable for subsequent spins of the play of the concentric object game. In another embodiment, the gaming system provides the higher of the two awards associated with the selected segments to the player. In another embodiment, the gaming system switches one of the two selected segments from the activated state to the deactivated state. In this embodiment, the gaming system renders one of the two selected segments un-selectable for the subsequent spins of the play of the concentric object game and the other of the selected segments remains selectable.

In another embodiment, the gaming system selects one segment and provides the award associated with multiple segments based on the selected segment. More specifically, in an example of this embodiment, the gaming system includes a plurality of concentric wheels. The gaming system of this example embodiment selects a first segment and provides the award associated with the selected first segment and the award values associated with each of the segments on each of the plurality of wheels inward of the selected first segment. For instance, if the selected first segment is on the outermost wheel of three concentric wheels, the gaming system provides three awards to the player. The first award being the award associated with the selected segment of the first wheel, the second award being the award associated with the segment of the second wheel directly inward of the selected segment, and the third award being the award associated with the segment of the third wheel directly below the segment of the second wheel that is directly inward of the selected segment of the first wheel.

In another embodiment, the gaming system selects one segment of the plurality of concentric wheels and switches multiple segments from the activated state to the deactivated state based on the selected segment. In certain embodiments, the gaming system randomly selects a first segment and deactivates the selected first segment and one or more additional segments for a subsequent spin of the play of the concentric wheel game. More specifically, in one example embodiment, the gaming system randomly selects a first segment and provides the award associated with the selected first segment. Additionally, in this example embodiment, the gaming system provides the award associated with the two segments adjacent to the selected first segment on the same wheel as the selected first segment. The gaming system switches each of the first segment and the two segments adjacent to the first segment from the activated state to the deactivated state, rendering all three segments un-selectable for a subsequent spin of the play of the concentric wheel game. In such embodiments, the gaming system creates a larger gap or opening in the wheel and increases the probability of selecting the remaining segments at a greater rate than if only one segment is switched from the activated state to the deactivated state.

In various embodiments, such as the embodiment described above, the gaming system displays the award associated with each of the plurality of segments. In another embodiment, the gaming system displays the plurality of concentric wheels without displaying the award associated with each segment.

In various embodiments, different wager levels are associated with different sets of awards. In other words, in these embodiments, the gaming system displays a first set of awards for each of the plurality of concentric objects when the player is playing at a first wager level, and the gaming system displays a second, different set of awards when the player is playing at different wager levels.

In various embodiments the award may be any suitable award such as, but not limited to: (1) monetary credits or currency; (2) non-monetary credits or currency; (3) a modifier such as a multiplier used to modify one or more awards; (4) one or more additional free spins of the wheels; (5) one or more free plays of a game (such as one or more free spins of a spinning reel type game); (6) one or more plays of one or more bonus games (such as a free spin of an award wheel); (7) one or more lottery based awards (such as one or more lottery or drawing tickets); (8) a wager match for one or more plays of the a wagering game; (9) an increase in an average expected payback percentage of a bonus game and/or an average expected payback percentage of a primary wagering game for one or more plays; (10) one or more comps (such as a free dinner or a free night's stay at a hotel); (11) one or more bonus or promotional credits usable for online play; (12) one or more player tracking points; (13) a multiplier for player tracking points or credits; (14) an increase in a membership or player tracking level; (15) one or more coupons or promotions usable within a gaming establishment and/or outside of the gaming establishment (e.g., a 20% off coupon for use at a retail store or a promotional code providing a deposit match for use in association with an online casino); (16) an access code usable to unlock content on the Internet; (17) a progressive jackpot or other progressive award; (18) a high value product or service (such as a car); (19) a low value product or service (such as a teddy bear); and (20) an increase in the value of one or more of the awards included in the paytable for a designated period (such as a designated period time or a designated quantity of plays of the concentric wheel game).

It should be appreciated that:

(a) the quantity of objects;
(b) the quantity of segments of each object;
(c) the awards associated with the award symbols;
(d) the duration of the play of the concentric object game;
(e) the quantity of spins;
(f) the quantity of segments that are initially activated;
(g) the quantity of segments that are deactivated for each spin;
(h) the quantity of segments that are initially selectable;
(i) the quantity of segments that the gaming system switches from selectable to un-selectable for each spin;
(j) the probability of selecting each segment of the concentric objects;
(k) the selection of which segment the gaming system selects;
(l) the quantity of selections of a segment prior to deactivation;
(m) the trigger to initiate the play of the concentric object game; and/or
(n) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM configured to operate the concentric object game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 5:
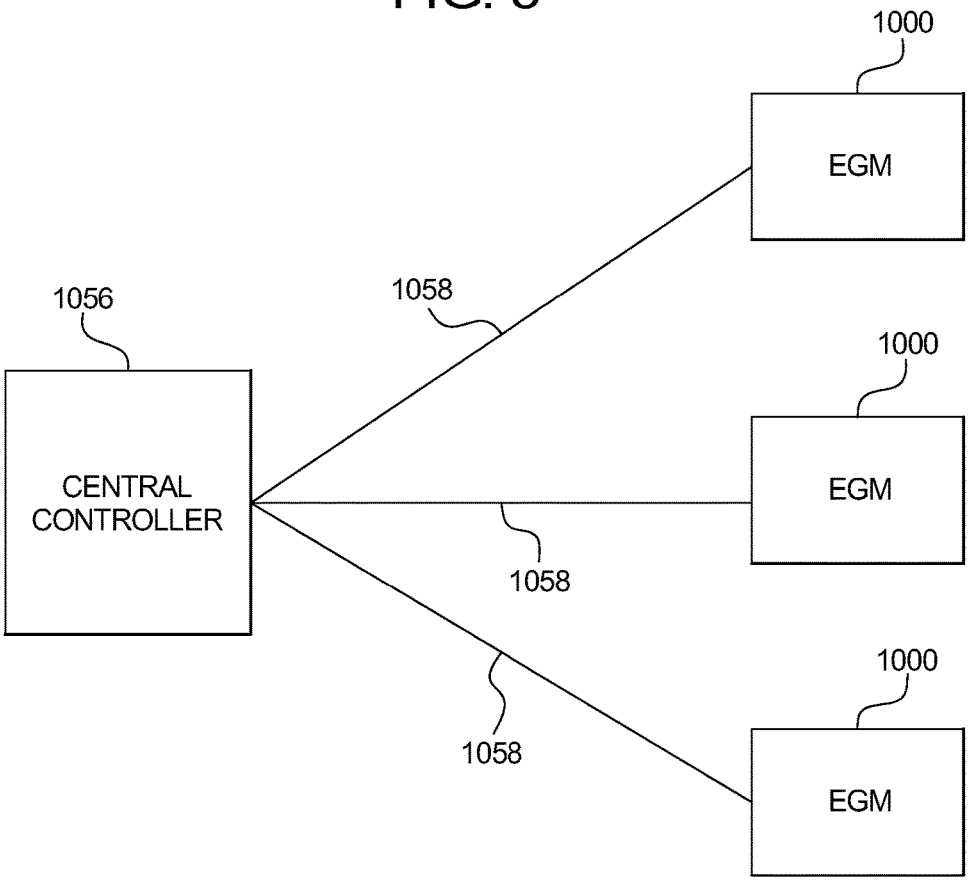
FIG. 5 is a schematic block diagram of one embodiment of a network configuration of the gaming system of the present disclosure.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 5 includes a plurality of EGMs 1000 that are each configured to communicate with a central server, central controller, or remote host 1056 through a data network 1058.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing devices) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing devices) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing devices) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing devices) is usable to access an Internet game page from any location where an Internet connection is available. In one such embodiment, after the EGM (or personal computing devices) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing devices), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing devices). Examples of implementations of Internet-based gaming are further described in U.S. Pat. No. 8,764,566, entitled "Internet Remote Game Server," which is incorporated herein by reference.

The central server, central controller, or remote host and the EGM (or personal computing devices) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 6:
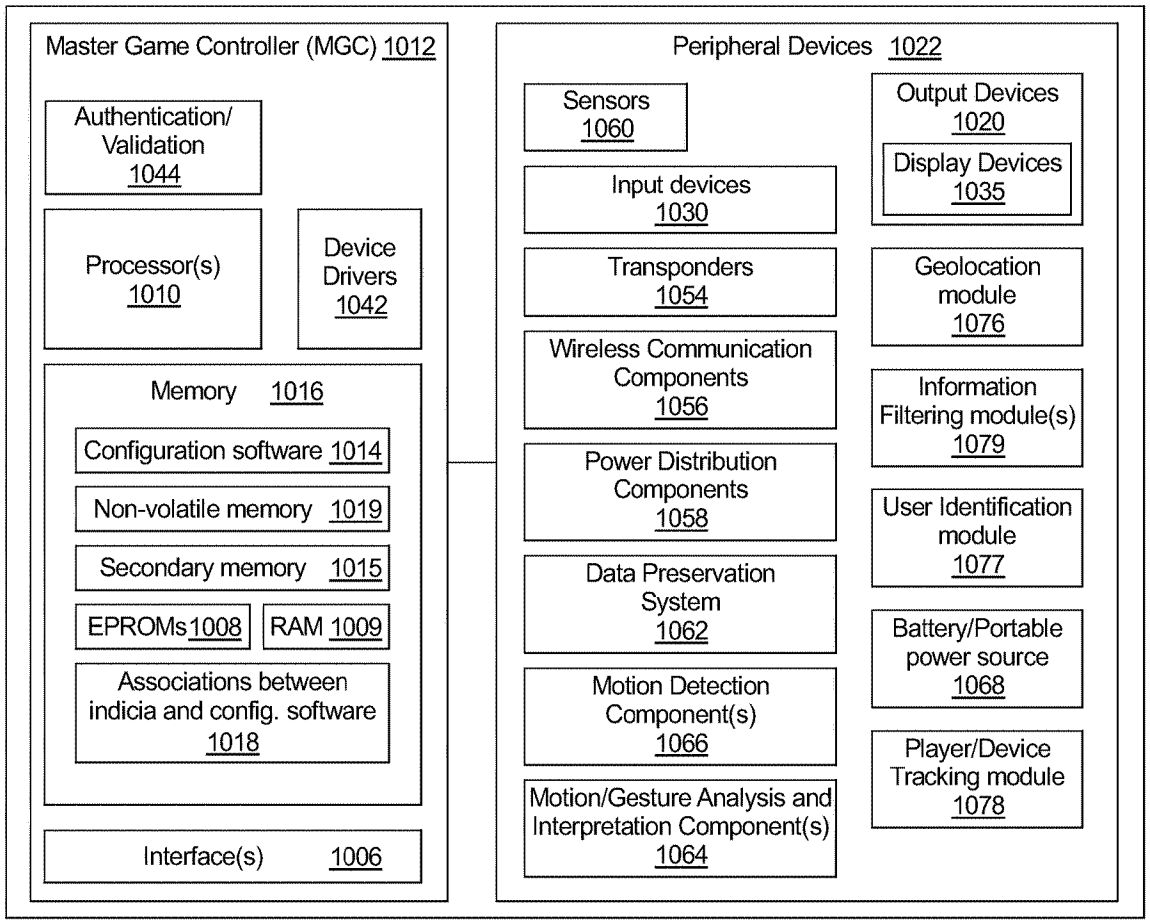
FIG. 6 is a schematic block diagram of an example electronic configuration of the gaming system of the present disclosure.
Figure 7A:
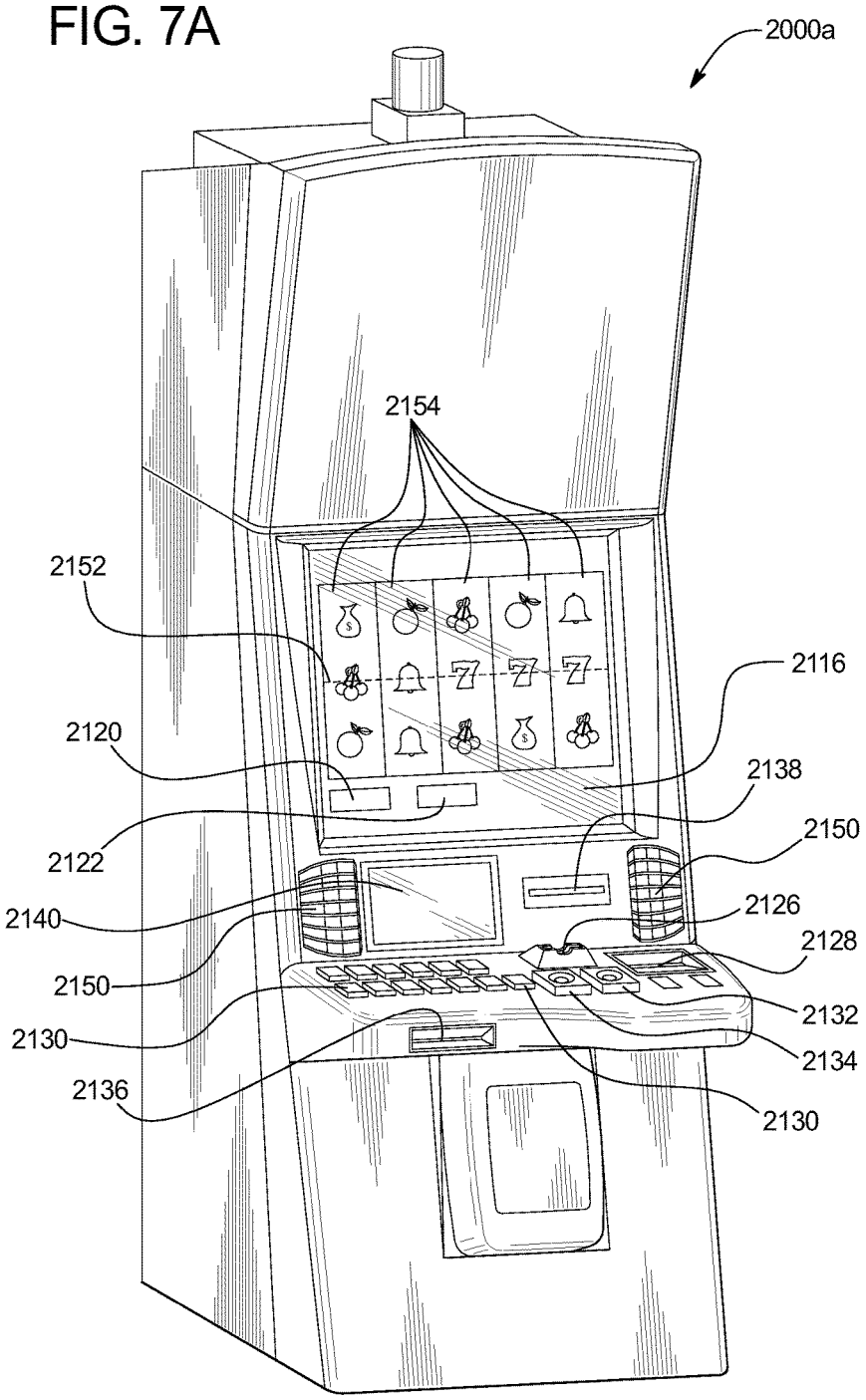
FIGS. 7A and 7B are perspective views of example alternative embodiments of the gaming system of the present disclosure.
Figure 7B:
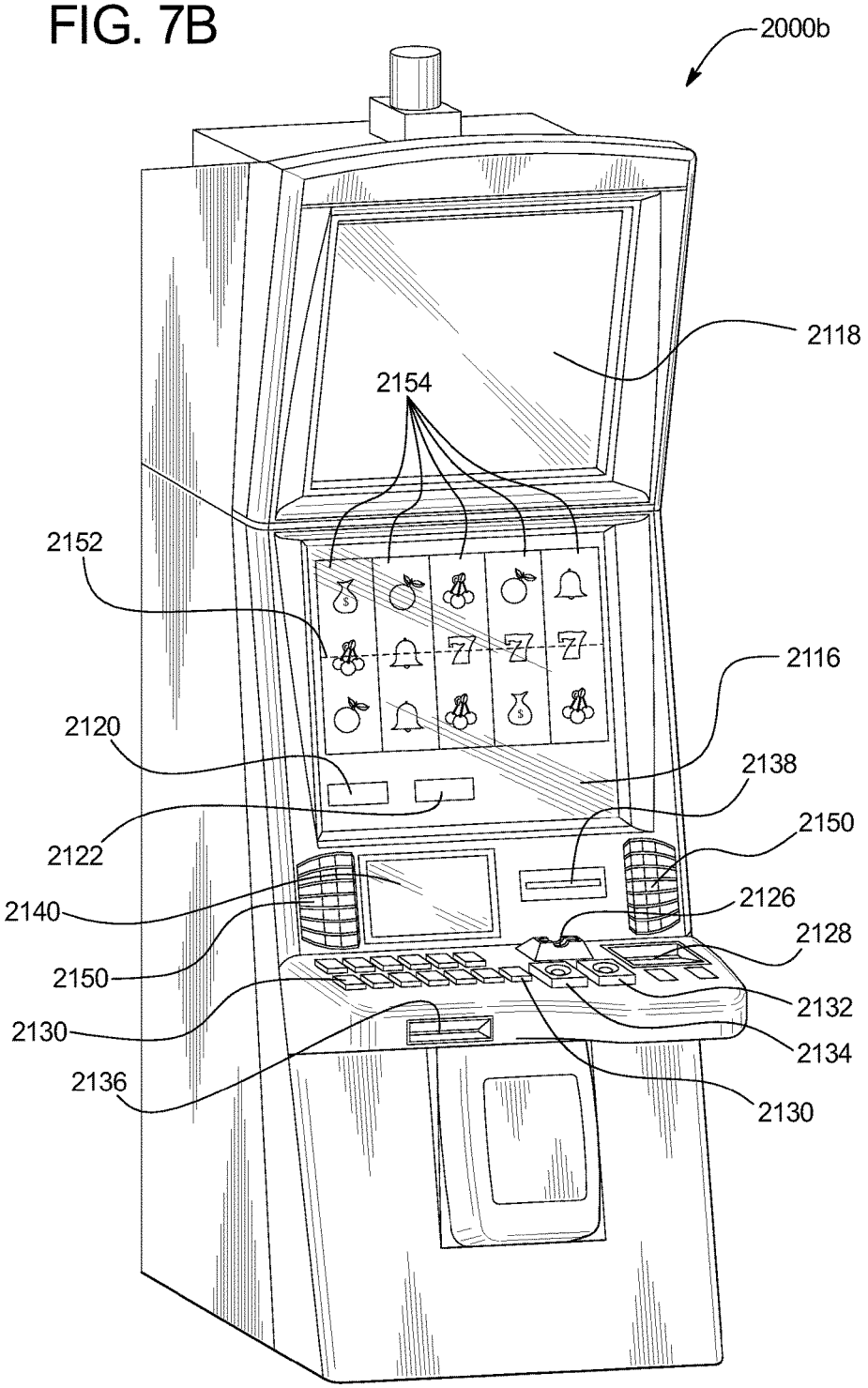

FIG. 6 is a block diagram of an example EGM 1000 and FIGS. 7A and 7B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022 (such as input/output devices). In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and other forms as commonly used in the gaming industry); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates using a serial communication protocol. A few non-limiting examples of serial communication protocols that may be used to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 7A includes a central display device 2116 and a player tracking display 2140. The example EGM 2000*b* illustrated in FIG. 7B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of the cashout device (described above), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 7A and 7B each include a ticket printer and dispenser 2136. Examples of ticket-in ticket-out ("TITO") technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account or a casino account of the player, via a transfer of funds onto an electronically recordable identification card or smart card of the player, or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 7A and 7B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrates in FIGS. 7A and 7B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 7A and 7B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 7A and 7B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 7A and 7B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 7A and 7B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 7A and 7B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 7A and 7B, EGMs may have varying housing and display configurations.

In certain embodiments, the EGM is a device that has obtained approval from a regulatory gaming commission, and in other embodiments, the EGM is a device that has not obtained approval from a regulatory gaming commission.

As explained above, for brevity and clarity, the term "EGM" is used herein to refer to an electronic gaming machine (such as an electronic gaming machine located on a casino floor) and a personal gaming device (such as a laptop computer or a mobile phone). Accordingly, certain of the example EGMs described above include certain elements that may not be included in all gaming systems. For example, the payment device of a personal gaming device such as a mobile telephone may not include a bill acceptor, while in certain instances the payment device of an electronic gaming machine located in a gaming establishment may include a bill acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electromechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 7B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

Differentiating Certain Gaming Systems from General Purpose Computing Devices Certain of the gaming systems described herein, such as electronic gaming machines located in a casino or another gaming establishment, include certain components and/or are configured to operate in certain manners that differentiate these systems from general purpose computing devices, i.e., certain personal gaming devices such as desktop computers and laptop computers.

For instance, electronic gaming machines are highly regulated to ensure fairness and, in many cases, electronic gaming machines are configured to award monetary awards up to multiple millions of dollars. To satisfy security and regulatory requirements in a gaming environment, hardware and/or software architectures are implemented in electronic gaming machines that differ significantly from those of general purpose computing devices. For purposes of illustration, a description of electronic gaming machines relative to general purpose computing devices and some examples of these additional (or different) hardware and/or software architectures found in electronic gaming machines are described below.

At first glance, one might think that adapting general purpose computing device technologies to the gaming industry and electronic gaming machines would be a simple proposition because both general purpose computing devices and electronic gaming machines employ processors that control a variety of devices. However, due to at least: (1) the regulatory requirements placed on electronic gaming machines, (2) the harsh environment in which electronic gaming machines operate, (3) security requirements, and (4) fault tolerance requirements, adapting general purpose computing device technologies to electronic gaming machines can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an electronic gaming machine because in an electronic gaming machine these faults can lead to a direct loss of funds from the electronic gaming machine, such as stolen cash or loss of revenue when the electronic gaming machine is not operating properly.

Certain differences between general purpose computing devices and electronic gaming machines are described below. A first difference between electronic gaming machines and general purpose computing devices is that electronic gaming machines are state-based systems. A state-based system stores and maintains its current state in a non-volatile memory such that, in the event of a power failure or other malfunction, the state-based system can return to that state when the power is restored or the malfunction is remedied. For instance, for a state-based electronic gaming machine, if the electronic gaming machine displays an award for a game of chance but the power to the electronic gaming machine fails before the electronic gaming machine provides the award to the player, the electronic gaming machine stores the pre-power failure state in a non-volatile memory, returns to that state upon restoration of power, and provides the award to the player. This requirement affects the software and hardware design on electronic gaming machines. General purpose computing devices are not state-based machines, and a majority of data is usually lost when a malfunction occurs on a general purpose computing device.

A second difference between electronic gaming machines and general purpose computing devices is that, for regulatory purposes, the software on the electronic gaming machine utilized to operate the electronic gaming machine has been designed to be static and monolithic to prevent cheating by the operator of the electronic gaming machine. For instance, one solution that has been employed in the gaming industry to prevent cheating and to satisfy regulatory requirements has been to manufacture an electronic gaming machine that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the electronic gaming machine in the presence of a gaming regulator. Regardless of whether the EPROM solution is used, to gain approval in most gaming jurisdictions, an electronic gaming machine must demonstrate sufficient safeguards that prevent an operator or a player of an electronic gaming machine from manipulating the electronic gaming machine's hardware and software in a manner that gives him an unfair, and in some cases illegal, advantage.

A third difference between electronic gaming machines and general purpose computing devices is authentication—electronic gaming machines storing code are configured to authenticate the code to determine if the code is valid before executing the code. If the code is not valid, the electronic gaming machine prevents the code from being executed. The code validation requirements in the gaming industry affect both hardware and software designs on electronic gaming machines. Certain electronic gaming machines use hash functions to authenticate code. For instance, one electronic gaming machine stores game program code, a hash function, and an authentication hash (which may be encrypted). Before executing the game program code, the electronic gaming machine hashes the game program code using the hash function to obtain a result hash and compares the result hash to the authentication hash. If the result hash matches the authentication hash, the electronic gaming machine determines that the game program code is valid and executes the game program code. If the result hash does not match the authentication hash, the electronic gaming machine determines that the game program code is not valid (i.e., may have been tampered with) and prevents execution of the game program code. Examples of electronic gaming machine code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between electronic gaming machines and general purpose computing devices is that the number and kinds of peripheral devices used on an electronic gaming machine are not as great as on general purpose computing devices. Traditionally in the gaming industry, electronic gaming machines have been relatively simple in the sense that the number of peripheral devices and the number of functions of the electronic gaming machine has been limited. Further, in operation, the functionality of electronic gaming machines was relatively constant once the electronic gaming machine was deployed, i.e., new peripherals devices and new gaming software were infrequently added to the electronic gaming machine. This differs from a general purpose computing device in which users can purchase different combinations of peripheral devices and software from different manufacturers and connect them to the general purpose computing device to suit their needs depending on a desired application. Therefore, the types of peripheral devices connected to a general purpose computing device may vary greatly from user to user depending in their individual requirements and may vary significantly over time.

Although the variety of peripheral devices available for a general purpose computing device may be greater than on an electronic gaming machine, electronic gaming machines still have unique peripheral device requirements that differ from a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an electronic gaming machine have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in electronic gaming machines that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain electronic gaming machines use a watchdog timer to provide a software failure detection mechanism. In a normally-operating electronic gaming machine, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain electronic gaming machines use several power supply voltages to operate portions of the computer circuitry. These can be generated in a central power supply or locally on the computer board. If any of these voltages falls out of the tolerance limits of the circuitry they power, unpredictable operation of the electronic gaming machine may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain electronic gaming machines have power supplies with relatively tighter voltage margins than that required by the operating circuitry. In addition, the voltage monitoring circuitry implemented in certain electronic gaming machines typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the electronic gaming machine.

As described above, certain electronic gaming machines are state-based machines. Different functions of the game provided by the electronic gaming machine (e.g., bet, play, result, points in the graphical presentation, etc.) may be defined as a state. When the electronic gaming machine moves a game from one state to another, the electronic gaming machine stores critical data regarding the game software in a custom non-volatile memory subsystem. This ensures that the player's wager and credits are preserved and to minimize potential disputes in the event of a malfunction on the electronic gaming machine. In general, the electronic gaming machine does not advance from a first state to a second state until critical information that enables the first state to be reconstructed has been stored. This feature enables the electronic gaming machine to recover operation to the current state of play in the event of a malfunction, loss of power, etc. that occurred just prior to the malfunction. In at least one embodiment, the electronic gaming machine is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the electronic gaming machine memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve electronic gaming machine critical data, although other types of non-volatile memory devices may be employed. These memory devices are typically not used in typical general purpose computing devices.

Thus, in at least one embodiment, the electronic gaming machine is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of electronic gaming machine critical information) within a time period of 200 milliseconds or less. In at least one embodiment, the time period of 200 milliseconds represents a maximum amount of time for which sufficient power may be available to the various electronic gaming machine components after a power outage event has occurred at the electronic gaming machine.

As described previously, the electronic gaming machine may not advance from a first state to a second state until critical information that enables the first state to be reconstructed has been atomically stored. After the state of the electronic gaming machine is restored during the play of a game of chance, game play may resume and the game may be completed in a manner that is no different than if the malfunction had not occurred. Thus, for example, when a malfunction occurs during a game of chance, the electronic gaming machine may be restored to a state in the game of chance just prior to when the malfunction occurred. The restored state may include metering information and graphical information that was displayed on the electronic gaming machine in the state prior to the malfunction. For example, when the malfunction occurs during the play of a card game after the cards have been dealt, the electronic gaming machine may be restored with the cards that were previously displayed as part of the card game. As another example, a bonus game may be triggered during the play of a game of chance in which a player is required to make a number of selections on a video display screen. When a malfunction has occurred after the player has made one or more selections, the electronic gaming machine may be restored to a state that shows the graphical presentation just prior to the malfunction including an indication of selections that have already been made by the player. In general, the electronic gaming machine may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the electronic gaming machine and the state of the electronic gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the electronic gaming machine prior to, during, and/or after the disputed game to demonstrate whether the player was correct or not in her assertion. Examples of a state-based electronic gaming machine, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of electronic gaming machines is that they often include unique interfaces, including serial interfaces, to connect to specific subsystems internal and external to the electronic gaming machine. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the electronic gaming machine, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between electronic gaming machines. As another example, SAS is a communication protocol used to transmit information, such as metering information, from an electronic gaming machine to a remote device. Often SAS is used in conjunction with a player tracking system.

Certain electronic gaming machines may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an electronic gaming machine by monitoring security switches attached to access doors in the electronic gaming machine cabinet. Access violations result in suspension of game play and can trigger additional security operations to preserve the current state of game play. These circuits also function when power is off by use of a battery backup. In power-off operation, these circuits continue to monitor the access doors of the electronic gaming machine. When power is restored, the electronic gaming machine can determine whether any security violations occurred while power was off, e.g., via software for reading status registers. This can trigger event log entries and further data authentication operations by the electronic gaming machine software.

Trusted memory devices and/or trusted memory sources are included in an electronic gaming machine to ensure the authenticity of the software that may be stored on less secure memory subsystems, such as mass storage devices. Trusted memory devices and controlling circuitry are typically designed to not enable modification of the code and data stored in the memory device while the memory device is installed in the electronic gaming machine. The code and data stored in these devices may include authentication algorithms, random number generators, authentication keys, operating system kernels, etc. The purpose of these trusted memory devices is to provide gaming regulatory authorities a root trusted authority within the computing environment of the electronic gaming machine that can be tracked and verified as original. This may be accomplished via removal of the trusted memory device from the electronic gaming machine computer and verification of the secure memory device contents is a separate third party verification device. Once the trusted memory device is verified as authentic, and based on the approval of the verification algorithms included in the trusted device, the electronic gaming machine is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

electronic gaming machines storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, electronic gaming machines that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing, said plurality of input devices including an acceptor and a validator;

at least one processor;

at least one display device supported by the housing; and at least one memory device that stores a plurality of instructions that, when executed by the at least one processor, cause the at least one processor to:

if a physical item is received by the acceptor, identify by the validator the received physical item and establish a credit balance based at least in part on the monetary value associated with the received and identified physical item;

display, via the at least one display device, a play of a game that includes, for a first activation of a plurality of objects, each object including a plurality of segments, each segment having an activated state and a deactivated state, and each segment being selectable or un-selectable, and each segment being associated with an award:

randomly selecting a first activated segment of a first object of the plurality of objects, wherein any activated segments of another one of the plurality of objects are un-selectable for the first activation of the plurality of objects;

displaying, via the at least one display device, the award associated with said selected first activated segment; and switching said selected segment of said first object of the plurality of objects from the activated state to the deactivated state such that at least one activated segment of a second object of the plurality of objects is selectable for a second subsequent activation of the plurality of objects; and if a cashout button is actuated, initiate a payout associated with the credit balance.

2. The gaming system of claim 1, wherein the objects are wheels.

3. The gaming system of claim 1, wherein the plurality of instructions, when executed by the at least one processor, cause the at least one processor, for the second subsequent activation of the plurality of objects, to:

randomly select a selectable second activated segment of one of the plurality of objects, wherein the activated segments of the first object of the plurality of objects and the activated segments of the second object of the plurality of objects are selectable for the second activation, and wherein any activated segments of another one of the plurality of objects are un-selectable for the second activation; and display, via the at least one display device, the award associated with said selected second activated segment.

4. The gaming system of claim 1, wherein the plurality of instructions, when executed by the at least one processor, cause the at least one processor to switch the selected segment from the activated state to the deactivated state by ceasing to display the selected segment.

5. The gaming system of claim 1, wherein the plurality of objects are mechanical objects supported by the housing, and which includes one or more lighting devices supported by the housing and configured to selectively illuminate the segments of the plurality of mechanical objects.

6. The gaming system of claim 5, wherein the mechanical objects are mechanical wheels.

7. The gaming system of claim 5, wherein the plurality of instructions, when executed by the at least one processor, cause the at least one processor to switch a segment from the activated state to the deactivated state by reducing an intensity at which the one or more lighting devices illuminates said segment.

8. The gaming system of claim 5, wherein the plurality of instructions, when executed by the at least one processor, cause the at least one processor to switch a segment from the activated state to the deactivated state by causing the one or more lighting devices to stop illuminating said segment.

9. The gaming system of claim 5, wherein a segment is in the activated state when said segment is illuminated by the one or more lighting devices.

10. A method of operating a gaming system, said method comprising:

if a physical item is received by an acceptor, identifying, by a validator, the received physical item and causing at least one processor to execute a plurality of instructions to establish a credit balance based at least in part on the monetary value associated with the received and identified physical item;

displaying, via at least one display device, a play of a game that includes: for a first activation of a plurality of objects, each object including a plurality of segments, each segment having an activated state and a deactivated state, and each segment being selectable or un-selectable, and each segment being associated with an award:

causing the at least one processor to randomly select a first activated segment of a first object of the plurality of objects, wherein any activated segments of another one of the plurality of objects are un-selectable for the first activation of the plurality of objects;

displaying, by the at least one display device, the award associated with said selected first activated segment; and causing the at least one processor to switch said selected segment of said first object of the plurality of objects from the activated state to the deactivated state such that at least one activated segment of a second object of the plurality of objects is selectable for a second subsequent activation of the plurality of objects; and if a cashout button is actuated, causing the at least one processor to initiate a payout associated with the credit balance.

11. The method of claim 10, wherein the objects are wheels.

12. The method of claim 10, which includes, for the second subsequent activation of the plurality of objects:

causing the at least one processor to randomly select a selectable second activated segment of one of the plurality of objects, wherein the activated segments of the first object of the plurality of objects and the activated segments of the second object of the plurality of objects are selectable for the second activation, and wherein any activated segments of another one of the plurality of objects are un-selectable for the second activation; and displaying, by the at least one display device, the award associated with said selected second activated segment.

13. The method of claim 10, which includes causing the at least one processor to switch the selected segment from the activated state to the deactivated state by causing the at least one display device to stop displaying the selected segment.

14. The method of claim 10, wherein the plurality of objects are mechanical objects supported by a housing, and which includes selectively illuminating the segments by one or more lighting devices supported by the housing.

15. The method of claim 14, wherein the mechanical objects are mechanical wheels.

16. The method of claim 14, which includes causing the at least one processor to switch a segment from the activated state to the deactivated state by reducing an intensity at which the one or more lighting devices illuminates said segment.

17. The method of claim 14, which includes causing the at least one processor to switch a segment from the activated state to the deactivated state by causing the one or more lighting devices to stop illuminating said segment.

18. The method of claim 14, wherein a segment is in the activated state when said segment is illuminated by the one or more lighting devices.

19. The method of claim 10, which is provided through a data network.

20. The method of claim 19, wherein the data network is an internet.

* * * * *